US012516522B2

(12) United States Patent
Chaudhari et al.

(10) Patent No.: US 12,516,522 B2
(45) Date of Patent: Jan. 6, 2026

(54) STAY-IN-PLACE CONCRETE FLOOR AND CEILING SYSTEM WITHOUT STEEL REINFORCING MADE FROM RECYCLED WIND BLADES

(71) Applicants: Ashok Chaudhari, Croton-on-Hudson, NY (US); Michael Molinelli, Briarcliff Manor, NY (US)

(72) Inventors: Ashok Chaudhari, Croton-on-Hudson, NY (US); Michael Molinelli, Briarcliff Manor, NY (US)

(73) Assignee: ST Bungalow LLC, Garrison, NY (US)

( * ) Notice: Subject to any disclaimer, the term of this patent is extended or adjusted under 35 U.S.C. 154(b) by 181 days.

(21) Appl. No.: 18/560,713

(22) PCT Filed: Jun. 14, 2022

(86) PCT No.: PCT/US2022/033420
§ 371 (c)(1),
(2) Date: Nov. 14, 2023

(87) PCT Pub. No.: WO2022/266089
PCT Pub. Date: Dec. 22, 2022

(65) Prior Publication Data

US 2024/0084590 A1 Mar. 14, 2024

Related U.S. Application Data

(60) Provisional application No. 63/212,697, filed on Jun. 20, 2021, provisional application No. 63/212,501, filed on Jun. 18, 2021.

(51) Int. Cl.
*E04B 5/36* (2006.01)

(52) U.S. Cl.
CPC ..... *E04B 5/36* (2013.01); *E04B 2103/02* (2013.01)

(58) Field of Classification Search
CPC ..... E04B 5/36; E04B 2103/02; E04G 11/46; E04G 9/05
(Continued)

(56) References Cited

U.S. PATENT DOCUMENTS 4,695,033 A * 9/1987 Imaeda ..... E04G 9/10 52/537
5,979,138 A * 11/1999 Allen ..... E04G 17/045 249/47

(Continued)

OTHER PUBLICATIONS

Goyal, Reema, "Bond between FRP formworks and concrete-effect of surface treatments and adhesives", Steel and Composite Structures, vol. 20, No. 3 (2016) pp. 671-692, Techno-Press, Ltd.

(Continued)

*Primary Examiner* — Paola Agudelo
(74) *Attorney, Agent, or Firm* — Ostrager Chong Flaherty & Broitman P.C.

(57) ABSTRACT

A building component system including a rigid plastic or fiberglass (FRP) form made from one of various shapes, an example of one such shape having an arch in each of two perpendicular vertical planes and having a plurality of protrusions configured to engage concrete poured on top of the rigid plastic form. The plastic is recycled plastic from wind turbine blades or consumer products such as plastic bottles. The plastic can be fiber reinforced such as an FRP (fiberglass reinforced plastic). The system also includes concrete poured on top of the form and cured to bind to the form at least at the plurality of protrusions, thereby forming an arched ceiling for a first story of a building and a flat roof or flat floor for a second story of a building. Bridge decking is another application, for use in infrastructure.

16 Claims, 20 Drawing Sheets

(58) Field of Classification Search
USPC ..... 52/173.1
See application file for complete search history.

(56) References Cited

U.S. PATENT DOCUMENTS

| | | | | |
|---|---|---|---|---|
| 5,987,680 | A * | 11/1999 | Sakaya | E01D 19/125 404/70 |
| 6,081,955 | A * | 7/2000 | Dumlao | E01D 2/00 52/783.17 |
| 6,131,343 | A * | 10/2000 | Jackson, Jr. | E04H 9/14 52/745.07 |
| 6,401,286 | B1 * | 6/2002 | Brenn | E04G 11/42 249/189 |
| 7,811,495 | B2 | 10/2010 | Dagher | |
| 7,984,541 | B1 | 7/2011 | Davidson | |
| 8,104,130 | B2 * | 1/2012 | Lerner | E01D 6/00 14/13 |
| 8,104,233 | B2 * | 1/2012 | Wilsey | E04B 1/161 52/783.17 |
| 8,850,750 | B2 | 10/2014 | Dagher | |
| 8,991,137 | B2 * | 3/2015 | Molinelli | B28B 7/0055 52/783.17 |
| D773,696 | S * | 12/2016 | Molinelli | D25/136 |
| 10,494,779 | B2 | 12/2019 | Dagher | |
| 11,242,689 | B2 * | 2/2022 | Dutil | E04G 11/46 |
| 11,964,408 | B2 * | 4/2024 | Van Doren | B28B 7/186 |
| 2010/0122504 | A1 | 5/2010 | Sarkisian et al. | |
| 2011/0073824 | A1 * | 3/2011 | Lappin | E04F 11/1836 29/428 |
| 2011/0185610 | A1 * | 8/2011 | Froio | G09F 15/00 40/606.17 |
| 2011/0203202 | A1 | 8/2011 | Uhl et al. | |
| 2014/0245691 | A1 | 9/2014 | Molinelli | |
| 2016/0115698 | A1 * | 4/2016 | Parodi | E04G 17/00 249/188 |
| 2017/0210074 | A1 | 7/2017 | Ueda et al. | |
| 2017/0218614 | A1 | 8/2017 | Ciuperca | |
| 2017/0268242 | A1 * | 9/2017 | Molinelli | E04G 11/46 |
| 2021/0198890 | A1 * | 7/2021 | Stehle | E04C 2/06 |
| 2022/0242009 | A1 * | 8/2022 | Espeland | B29B 17/04 |
| 2023/0120088 | A1 * | 4/2023 | Sant | B01D 53/1425 106/817 |

OTHER PUBLICATIONS

Oval, Robin, "A path towards the off-site automated fabrication of segmented concrete shells for building slabs", IASS 2020/21 Surrey 7, International Conference on Spatial Structures 2020/21, Aug. 23-27, 2021; Guilford, UK.

Goyal, Reema "An investigation on bond between FRP stay-in-place formwork and concrete", Elsevier, Construction and Building Materials 113, (2016) pp. 741-751.

Brozda, Kinga, "The GFRP profiles as stay-in-place formwork", E3S Web of Conferences 49, 00008, Solina 2018.

Oval, Robin, "A prototype low-carbon segmented concrete shell building floor system", Structures 49 (2023), pp. 124-138, Elsevier Ltd on behalf of Institution of Structural Engineers, Jan. 11, 2023.

International Preliminary Report on Patentability, PCT/US2022/033420, dated Dec. 14, 2023.

PCT International Search Report and Written Opinion, PCT/US2022/033420, dated Sep. 12, 2022.

* cited by examiner

7 WEEKS

15 WEEKS
ADDED 10 POUNDS
(TOTAL 60)

16 WEEKS
ADDED 10 POUNDS
(TOTAL 70)

17 WEEKS
ADDED 11 POUNDS
(TOTAL 81)

STAY-IN-PLACE CONCRETE FLOOR AND CEILING SYSTEM WITHOUT STEEL REINFORCING MADE FROM RECYCLED WIND BLADES

CROSS-REFERENCE TO RELATED APPLICATIONS

This application is a 371 application of PCT Application No. PCT/US2022/033420 filed Jun. 14, 2022, which claims benefit of U.S. Provisional Application Nos. 63/212,501, filed Jun. 18, 2021, titled "Building Components Made from Recycled Wind Turbine Blades" and 63/212,697, filed Jun. 20, 2021, titled "Low Clinker Reduced Cement Building Component Solution", the entire contents of which are hereby incorporated by reference as if fully set forth herein.

TECHNICAL FIELD

This disclosure relates generally to building component systems and, more particularly, to a concrete floor and ceiling system comprising a non-ferrous form or profile made primarily from recycled material.

BACKGROUND

Concrete construction has brought many advantages to the construction industry since being reintroduced to the world in the late 19$^{th}$ century. Poured concrete was used in ancient Rome, famously for the dome of the Pantheon, but the recipe was lost for millennia. Concrete (composed of Portland Cement, sand, aggregate and water) offers many advantages to other types of framing, including, among others, that: 1) it is composed of basic and easily transported materials; 2) it is malleable when first mixed so it can assume many shapes; 3) it has great compressive strength; and 4) it is resistant to fire.

However, concrete is poor in its tensile strength. For this reason, it is paired with steel often in the form of re-bar (reinforcing bars) and/or wire mesh. Such pairing is labor intensive regarding transport and placement and even when covered with concrete, steel is known to corrode when exposed to water or moisture. Concrete also requires a labor-intensive complex formwork to be placed so that the final structure can assume an irregular shape; and, after the concrete is set, the forms must be removed. While modern reusable form systems have reduced the cost of material, the labor costs remain high.

In U.S. patents and publications U.S. Pat. No. 8,991,137B2, 20170268242A1 and U.S. D773,696S1 by Michael Molinelli, all incorporated by reference in their entirety herein, methods, products and designs are disclosed for making housing components from forms made from fiberglass and/or plastic. In combination with concrete, cement or ferro-cement, these fiberglass and/or plastic forms are used to make roofs or floors or walls, for example, and replace steel re-bars, corrugated steel roofs, or wooden roofs.

In today's wind turbine industry, it is well known that recycling of wind turbine blades is problematic. To date, most of these blades are put in landfills. While wind blades are non-toxic, the industry is intensely exploring ways to recycle the wind blades for use rather than discarding in landfills. Such a "circular" economic approach is highly desirable but difficult to achieve. A product is sorely needed that can make use of recycled wind blades at large scale; and if this product were highly sought after with great market demand it could "drive" circularity and the recycling of wind blades could thereby become much more cost effective, and the recycling problem solved. The present invention provides just such a product or structure and also a method for manufacturing the product. The invention can also be applied to other industries which use composites where the very same recycling problem exists, for example, in boating. The present invention is a continuation of the aforementioned patents by Michael Molinelli, incorporated by reference to their entirety herein, with certain improvements and modifications regarding manufacturing methods and structure of the "non-ferrous" (non-steel) plastic and fiberglass forms previously disclosed, which solve today's industry problems named above.

In addition to these improvements over the prior art, it has become apparent to the inventors that the present invention can be used to solve a problem not only in the wind turbine blade industry but in the concrete industry, namely, how to use concrete that is low in carbon yet also weaker than regular concrete. In other words, the present invention can be applied in situations where regular steel reinforcement bars or fiberglass reinforced polymer (FRP) bars are not able to supply the tensile strength needed to use low carbon concrete. A further significant contribution to the concrete industry is thereby also achieved by the present invention further distinguishing it from the prior art.

SUMMARY OF THE INVENTION

Techniques and structures are provided for a consumable formwork that is incorporated into the final structure, "stays in place", and provides sufficient tensile strength that steel reinforcing can be omitted entirely or partially. For example, 40% less steel or fiberglass reinforced bar may be needed, or 60% or 90% less, or 100%.

In a first set of embodiments, a building component system includes a rigid plastic and/or fiberglass reinforced plastic (FRP) form having an arched shape in each of two perpendicular vertical planes and having a plurality of protrusions configured to engage concrete poured on top of the rigid plastic form. The system also includes concrete poured on top of the form and cured to bind to the form at least at the plurality of protrusions, thereby forming an arched ceiling for a first story of a building and a flat roof or flat floor for a second story of a building.

In some embodiments of the first set, when the form is placed on a flat surface, a space below the form is sufficient for use as a residence for humans or animals or equipment or some combination. It can also serve as a space for wiring or insulation.

In some embodiments of the first set, the concrete is not reinforced with steel or FRP bars.

In some embodiments of the first set, the system includes two or more temporary vertical forms disposed outside the rigid plastic and/or FRP form for providing an outer perimeter of the building component, and temporary shoring supports wherein the temporary vertical forms and temporary shoring supports are removed after the concrete is poured and cured.

In some embodiments of the first set, a plurality of the rigid plastic and/or FRP forms stack efficiently for transportation of the plurality of rigid non-ferrous (plastic or FRP) forms.

In some embodiments of the first set, the system includes a mold configured to fabricate the rigid plastic and/or FRP form by injection molding.

In some embodiments of the first set, the system includes forms (or profiles) that are fabricated by pultrusion or extrusion manufacturing techniques commonly used in the composites industry, e.g., fiberglass (FRP) rebar industry, for example.

In some embodiments of the first set, the system includes forms (or profiles) that are fabricated by 3D printing techniques known in the industry, using a combination of recycled FRP and thermoplastic for the first time.

In some embodiments of the first set, the forms or profiles are made from recycled wind turbine blade materials, i.e., FRP, that in turn have been extracted using pyrolysis or chemicycling or mechanical methods or any other method commonly employed in the wind turbine blade recycling industry.

In some embodiments of the first set, the forms (or profiles) are made purely from recycled plastic, and the plastic used is from recycled bottles or any other kind of consumer product that uses plastic.

In some embodiments of the first set the forms are made of recycled composite materials, e.g. FRP, that come from industries other than wind, such as boating, aviation, etc.

In some embodiments of the first set, a form that can be made from any combination of the materials used in and extracted from wind turbine blades. For example, fiberglass, plastic, epoxy, silicon, carbon, resin, and any materials used in wind blades of any kind, onshore or offshore.

In some embodiments of the first set, the forms can have one of many shapes. They can be in the shape of a trapezoid, a simple arch or vault, a rectangle, and other shapes.

In some embodiments of the first set, the form can be made from cut pieces of the actual wind blade. It is well known in the art, that wind blades can be cut down to specific sizes using a diamond saw, for example. The wind blades could be cut down to 12 foot (3.6 meters) long arched pieces and used directly as the form in the building component, which is then combined with cement or concrete or another binder.

In some embodiments of the first set, the concrete used is a low carbon concrete, or "Ecopolycrete" made by Global Fiberglass Solutions (GFS), with certain properties advantageous both to low carbon emission, tensile strength, and bonding with the plastic non-ferrous stay-in-place forms.

In some embodiments the concrete once set also provides protection from fire spread, the duration of which needs to be tested to see if it conforms with 1-hour, 2-hour or any higher rated construction.

In some embodiments the forms (or profiles) are made fireproof by adding a coating or some additive or chemical designed as a flame retardant or designed for fire proof materials and products.

In some embodiments computational design and digital tools are used to optimize the shapes of the forms to achieve for example the optimal tensile strength or the least amount of concrete needed.

In some embodiments the forms, which can be made by 3D printing processes, will have the grooves or rivets often seen in 3D printed products. These grooves can be an advantage is helping adherence or bonding of the forms to concrete.

In some embodiments, the curing time of the concrete when poured onto the forms is reduced by many hours when compared to standard concrete reinforcement methods. Curing time reduction of 10 hours, 20 hours, 40 hours, 2 days, 10 days is possible.

In some embodiments the load capability of the "flatwork" structure is increased to way over the 2.5 kN/m2 requirement, 10.1 kN/m2 was achieved.

In some embodiments the present stay-in-place non-ferrous structure resembles Hourdi blocks commonly used in flatwork construction yet is sharply different in for various reasons, e.g., Hourdi blocks do not use shapes such as arches to achieve tensile strength. Moreover, their composition is not recycled wind blade FRP or plastic.

In some embodiments, concrete spraying is used instead of standard pouring in order to improve the adhesion or bonding of the concrete to the non-ferrous plastic forms.

In some embodiments, the method and structure of the stay-in-place forms allow for the use of low carbon cement and concrete for flatwork providing the tensile strength otherwise lacking in traditional steel rebar or GFRP rebar products.

In one embodiment, the floor or roof or "flatwork" structure created by the present invention is such that a thinner or lighter "flatwork" is achieved. The elimination of heavy steel rebar combined with the lighter weight forms made from FRP and/or plastic combined with less concrete use or "lightweight" concrete make this desirable outcome possible. For example, with regard to thickness, the total depth of the floor/roof structure can be less than 69 cm or 2 ft 3 inches.

In a second set of embodiments, a method includes placing a rigid plastic and/or FRP form made from recycled materials and having an arched shape in each of two perpendicular vertical planes and having a plurality of protrusions configured to engage concrete poured on top of the rigid plastic form and placing two or more simple vertical forms outside the rigid plastic form for providing an outer perimeter of a building component. The method includes pouring and curing concrete on top of the form to bind to the form at least at the plurality of protrusions. The method also includes after the concrete cures, removing the two or more simple vertical forms, thereby forming an arched ceiling for a first story of a building and a flat roof or flat floor or "slab" for a second story of a building.

In a third embodiment, concrete can be poured on each individual form (with shoring) away from the construction site "off-site" and cured. Then each new piece can be transported separately to the sight and adjoined on site. The drawback of this approach is that that there will be extra weight in transportation rather than when the concrete mixing is done on site. Also, the individual FRP/plastic form/concrete units would have to be attached or linked by joints in order to make a complete flatwork building structure.

In sum, the present technology provides a method for making monolithic low carbon flatwork where the entire structure, e.g., floors or roofs, have new and various shapes (arches, trapezoids, domes), and are thin and lightweight acid comprised of low carbon materials only. Moreover, the technology allows for using various types of "weaker" concrete products, such as low carbon concrete, bio-concrete, etc. Finally, the present invention, depending on the shapes used in the forms, may allow for a significant reduction in the amount of concrete in contrast to what is commonly used in the industry today with steel or GFRP bar reinforcement.

In the present specification, it should be made clear that there is sharp and distinct difference between the terms 'plastic' and 'FRP'. The latter is a composite material in which plastic is used and incorporated. In the present invention, some combination of the two materials makes for an ideal material used in the production of the shaped stay-in-place forms.

Still other aspects, features, and advantages are readily apparent from the following detailed description, simply by illustrating a number of particular embodiments and implementations, including the best mode contemplated for carrying out the invention. Other embodiments are also capable of other and different features and advantages, and its several details can be modified in various obvious respects, all without departing from the spirit and scope of the invention. Accordingly, the drawings and description are to be regarded as illustrative in nature, and not as restrictive.

BRIEF DESCRIPTION OF THE DRAWINGS

Embodiments are illustrated by way of example, and not by way of limitation, in the figures of the accompanying drawings in which like reference numerals refer to similar elements and in which.

DETAILED DESCRIPTION

Figure 1A:
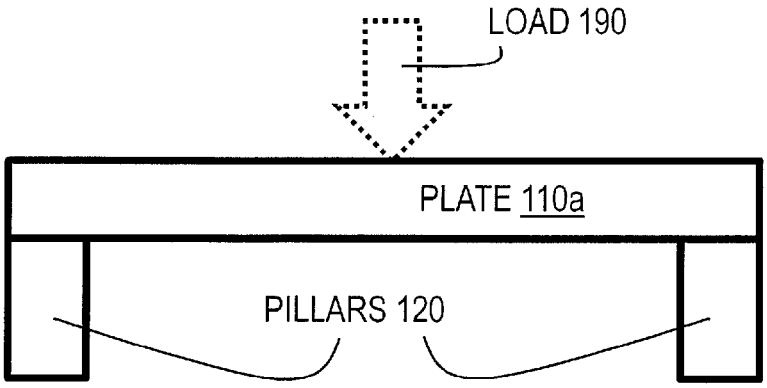
FIG. 1A and FIG. 1B are block diagrams that illustrate example compression and tensile forces on a concrete slab that are to be modified according to an embodiment.

A method and apparatus are described for consumable stay-in-place formwork for concrete structures without steel reinforcing and using recycled composites (FRP) from wind blades and/or plastic from other consumer products such as bottles. The concrete structures can be "flatwork," e.g. floors and roofs. Moreover, it is an additional aspect of the present invention that it allows for the use of low carbon cement or concrete in the construction of the flatwork. In the following description, for the purposes of explanation, numerous specific details are set forth in order to provide a thorough understanding of the present invention. It will be apparent, however, to one skilled in the art that the present invention may be practiced without these specific details. In other instances, well-known structures and devices are shown in block diagram form in order to avoid unnecessarily obscuring the present invention.

Notwithstanding that the numerical ranges and parameters setting forth the broad scope are approximations, the numerical values set forth in specific non-limiting examples are reported as precisely as possible. Any numerical value, however, inherently contains certain errors necessarily resulting from the standard deviation found in their respective testing measurements at the time of this writing. Furthermore, unless otherwise clear from the context, a numerical value presented herein has an implied precision given by the least significant digit. Thus, a value 1.1 implies a value from 1.05 to 1.15. The term "about" is used to indicate a broader range centered on the given value, and unless otherwise clear from the context implies a broader range around the least significant digit, such as "about 1.1" implies a range from 1.0 to 1.2. If the least significant digit is unclear, then the term "about" implies a factor of two, e.g., "about X" implies a value in the range from 0.5× to 2×, for example, about 100 implies a value in a range from 50 to 200. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 4.

Some embodiments of the invention are described below in the context of a particular shape for stackable forms. However, the invention is not limited to this context. In other embodiments the forms do not stack but are fabricated in place using one or more molds and a supply of a suitable plastic material with an injection molding process, or using a 3D printer and a supply of a suitable plastic material, for example some combination of thermoset and thermoplastic material suitable and ideal for 3D printing of the forms.

As used herein the term "plastic," when used as a noun, is sharply and clearly distinguished from composite or fiberglass reinforced plastic (FRP) and refers to a material consisting of any of a wide range of synthetic or semi-synthetic organic compounds that are malleable and can be molded into solid objects. Plastics are typically organic polymers of high molecular mass, but they often contain other substances. They are usually synthetic, most commonly derived from petrochemicals, but many are made from renewable materials such as polylactic acid from corn or celluloses from cotton linters. Plasticity is the general property of all materials that are able to irreversibly deform without breaking, but this occurs to such a degree with this class of moldable polymers that their name is an emphasis on this ability. Due to their relatively low cost, ease of manufacture, versatility, and imperviousness to water, plastics are used in an enormous and expanding range of products. Unfortunately, plastic waste has caused great damage to the environment and the present invention seeks to mitigate this damage by offering a product that makes use of recycled plastic. Of course, plastic is also used in wind blades as part of a composite material called fiberglass reinforced plastic (FRP). FRP or Glass Fiber Reinforced Plastics (GFRPs) are a primary candidate for material in the present invention as they comprise 90% of wind turbine blades and it is estimated that in the coming years an enormous number of wind blades will either be de-commissioned due to age or upgraded worldwide. However, although more expensive, another candidate is Carbon Reinforced Plastics (CFRPs). Carbon fiber is also used to make wind blades and is also recyclable.

While the present invention is chiefly concerned with the use of recycled FRP or plastic or some combination thereof to make the forms, it should be noted that other materials that can be shaped are also possible and may have beneficial qualities. One such material is foam. Similarly, various types of concrete products can be applied in the present invention.

As previously stated above, the use of fiberglass or plastic forms as taught by M. Molinelli may in fact allow the use of a new type of cement with certain advantages previously impossible to use without product failure. Here, as just one non-limiting example we disclose an invention for enhancing the previously disclosed building product by improving the quality of cement used in combination with the fiberglass (FRP) or plastic forms. In today's cement industry, it is desirable that the cement (and concrete derived from the cement) is made with as little carbon dioxide, both by content and emission from fabrication, as possible. This is due to efforts world-wide to cut greenhouse gas emissions. One way of lowering the amount of CO2 used in cement fabrication is to reduce the amount of clinker, the primary component used in cement. (Portand cement contains up to 95% clinker, while the average clinker to cement ratio is 73.7%.) Clinker results in CO2 in two ways: through its fabrication process and through thermal decomposition post fabrication. The problem is that when reducing the amount of clinker the cement can be weakened or lose other attributes essential to high performance such as resilience. Application of a cement with sufficiently reduced clinker content from a CO2 emission standpoint may thus not be possible for many building component applications such as roofs or floors for example. In the present invention, the weakness and resilience limits of cement is extended or increased due to the use of fiberglass or plastic forms (described in the above patents by Molinelli, incorporated by reference to their entirety herein). Moreover, the use of the fiberglass (FRP) and/or plastic forms taught by Molinelli also may require lower amounts of cement and concrete while sill achieving the same (if not better) outcome as would be achieved using standard metal re-bars and mesh combined with cement or concrete or GFRP rebar. Reduced amounts of cement containing carbon means lower overall CO2 usage in the buildings, whether residential or commercial. Furthermore, the overall energy required to build the unit (residential or commercial) is lowered due to the lighter load of the flatwork.

In another embodiment of the present invention, the cement used is, surprisingly, actually stronger and more expensive than the low carbon cement but since less of this stronger cement is required to achieve an acceptable outcome, the additional clinker and higher CO2 requirements in this more expensive cement are offset by the lower quantity required when deposited on the fiberglass FRP and/or plastic forms made from recycled materials, of the present invention.

The following is a non-limiting description of the clinker content in the novel cement product disclosed herein: the amount of clinker content can be 75%, 60%, 65%, 40%, and 10%. The exact amount desirable must be determined by careful experimentation in combination with the fiberglass and/or plastic forms and technique invented by Michael Molinelli and referred to in the aforementioned patents (U.S. Pat. No. 8,991,137B2, 20170268242A1 and U.S. D773,696S1). Furthermore, it may be desirable to substitute clinker with other materials that have binding properties such as mineral components. Such minerals could be tuff, limestone, etc. Or they could be waste from or byproducts from the wind blade industry or other industries. The product made from such substitutes may also be weaker and less resilient than say Portland Cement, yet when combined with fiberglass and/or plastic forms taught by Molinelli, the overall product is sufficient or even better.

Recently, carbon fiber cement has been invented and demonstrated. This new type of cement is comprised of both cement and carbon fibers and can be used without reinforcement. In this way, structures can be much thinner since much of the thickness of steel-reinforced concrete is due to the need to prevent water penetration leading to oxidization of the rebar. The present invention achieves a similar outcome but without necessarily having to modify the cement or concrete. Standard cement, or more precisely concrete, is simply poured on the consumable stay-in-place forms and left to cure. No steel re-bar is necessary. Alternatively, low carbon concrete can be used so that the entire structure becomes a low carbon housing solution that is also less likely to corrode in situations where water or moisture are present which increasingly is a problem resulting from climate change. In the present invention, various kinds of cement and concrete products can be used depending on the desired outcome. According to RE202 (French building code), low carbon concrete and bio-concrete require greater compression assistance which is provided by the present invention. Moreover, while FRP rebar exists on the market today, it cannot be made from recycled wind blade material nor is it easy and quick to install. Likewise, it will be appreciated that low carbon rebar (steel or FRP) will be too expensive when compared to the recycled material in the present invention. Similarly, nickel is used for corrosion free steel and the prices of nickel are high.

It should be noted that the composition of the recycled material used in the manufacturing of the stay-in-place non-ferrous forms of the present invention may consist of various combinations of composite material and thermoplastic material and/or resin. For example, the material may be 80% recycled FRP and 20% recycled or virgin thermoplastic. Or 50% composite FRP and 50% thermoplastic. Or 90% composite FRP and 10% thermoplastic. Resin and other additives can comprise the final material used in making the forms. For example, it may be advantageous to add some epoxy or fire retardant or special kinds of resin that assist in bonding with the concrete. Thus, in stating that the material consists of FRP and/or plastic, it does not exclude small amounts other materials or chemicals that may improve the overall performance of the form. Moreover, the length of the fibers in the recycled FRP can be varied depending on the desired outcome, with longer fibers providing additional tensile strength. For example, instead of 1 cm long glass fibers, 3 cm may be used. It may be helpful to add a resin to the material composition in order to improve the form. In this case, vinyl ester resin is preferable to polyester resin.

Overview of Forms

Figure 1B:
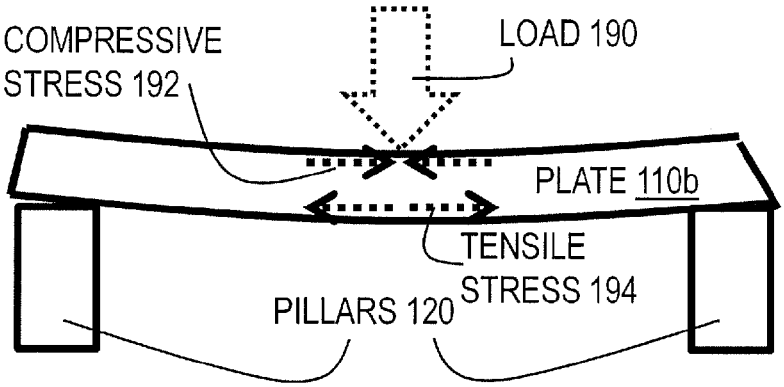

FIG. 1A and FIG. 1B are block diagrams that illustrate example compression and tensile forces on a concrete slab that are to be modified according to an embodiment of the present invention. Compression forces act to compress a material by pushing molecules together, while tensile forces act to pull molecules apart by pulling on a material in opposite directions causing the material to stretch. The force is usually expressed as a stress, which is a force per unit area. Both compressive stress and tensile stress come to bear when a bending force or stress is applied to a structure, as indicated in FIG. 1A and FIG. 1B. FIG. 1A depicts a plate 110*a* suspended on two pillars 120 subjected to a bending force, called load 190, caused by the weight of the plate 110*a* or some additional objects placed on the plate 110*a*, or some combination. In response, as depicted in FIG. 1B, the plate 110*b* tends to bend into a configuration in which the material close to the bending force is subject to a compressive stress 192 and the material opposite the bending force is subject to a tensile stress 194.

As stated above concrete is a common building material. While concrete is resistant to failure due to compressive stress 192, it is subject to failure due to tensile stress 194. Tensile strength is a measure of the ability of a material to withstand a tensile stress, expressed as the greatest tensile stress that the material can stand without breaking. For this reason a concrete plate or slab is constructed with steel bars, called reinforcement bars (or "rebar"), because steel has a higher tensile strength than concrete. However, steel is expensive and heavy to move. As a consequence, steel rebar is not readily available in many disadvantaged areas where housing and other buildings are needed.

Plastic is a lighter and less expensive material than steel, and thus plastic is more readily available in disadvantaged areas than steel. In addition, plastic has superior tensile strength compared to concrete. Furthermore, the malleable properties of plastic also are advantageous for generating forms of arbitrary shape. Thus, it is advantageous to use plastic for both purposes simultaneously, e.g., to provide forms for shaping concrete and to stay in place to provide tensile strength for the resulting concrete structure. To provide tensile strength for the resulting structure, features are added to the plastic forms to engage the concrete; and, thus, work with the concrete to resist various loads that impart a tensile stress. Furthermore, plastic is superior to pure fiberglass (not FRP) suggested in the prior art, because the tensile strength of plastic is much greater (about 16 times greater) than the tensile strength of fiberglass (not FRP) that has a tensile strength only slightly greater (less than a factor of two greater) than concrete. Table 1 summarizes tensile strength and other properties of these materials. In the present invention, some combination of recycled plastic and composite materials is preferable. For example, thermoplastic combined with FRP from recycled wind blades. It will be appreciated that if the strength or structure of recycled plastic or composites is weakened, that additives such as virgin resin or epoxy can be introduced to strengthen the material.

TABLE 1

Properties of various materials.

| Material | Compressive Strength (psi) | Tensile Strength (psi) | Modulus of Elasticity (psi) | Density (pcf) |
|---|---|---|---|---|
| Concrete | 4,000 | 500 | 3,600,000 | 150 |
| Steel | 36,000 | 70,000 | 29,000,000 | 483 |
| Fiberglass (70% Egb) | 135 | 805 | 1,200,000 | 112 |
| Plastic (nylon 6) | 12,000 | 13,000 | 1,800,000 | 83 |

In some embodiments, the recycled plastic/FRP forms are shaped to provide sufficient height and width for the resulting structure such that the resulting structure can be used as a supported ceiling for a first story and a floor for the story above. Thus modular buildings can be rapidly constructed with one or a few different plastic/FRP forms and concrete without steel reinforcing, e.g., without steel rebar. In many embodiments, the formwork's geometry uses parabolas and arches to push the concrete to almost pure compression, especially as the bending load moves from the center toward the edges. In some embodiments, the forms are also shaped to efficiently stack, which is an advantage in the transport of multiple such forms. In some embodiments, the forms are fabricated on site, and the forms need not be designed to stack efficiently. In some embodiments the forms are made entirely from recycled plastics either from wind blades or other consumer products.

Thus the embodiments described herein are distinguished over the fiberglass forms described in prior U.S. Pat. No. 8,991,137 and 20170268242A1 by Michael Molinelli by using recycled plastics or composites including fiberglass reinforced plastic (FRP) from products such as wind turbine blades or boats for the forms and making them in a variety of shapes and all designed to be "stay-in-place" on to which concrete is then poured; and the concrete can be a low tensile strength, sustainable concrete consisting of low carbon cement with a lower tensile strength than standard concrete used in the industry. The embodiments described herein are further distinguished over the above prior art because the prior art is silent about the forms solving the problem of providing the reinforcement necessary to use "weaker" concrete such as low carbon concrete or bio-concrete. The embodiments described herein are especially well suited for adverse climate situations and allow for a low carbon emitting product crucial to combat global warming using plastic waste either from wind blades or plastic bottles and other consumer products enabling a circular and sustainable business.

When considering the production of the present stay-in-place forms, a mechanical recycling process can be used to generate or "shred" plastic or FRP from wind blades. From this shredded material, small pellets (approx. 1-2 cm2) can then be made which in turn can be used in a variety of machines such as 3D printers or vacuum injection molds when combined with thermoplastic and/or resin to make the forms. The latter step is an additional novel and inventive feature of the present invention being disclosed for the first time. It may be preferable however to recycle the wind blades in such as a way as to segregate out the individual component materials of the blades rather than to process them mechanically so as to obtain new recycled raw material for use in the forms. For example, most wind turbine blades are made of fiberglass reinforced polyester, plastic (FRP) or fiberglass reinforced epoxy. Carbon fiber or aramid (Kevlar) is also used as a material. Furthermore, PMCs (Polymer Matrix Composites) are used, usually thermosets but also thermoplastics. Epoxy resins are an important component in most wind blades and could be extracted separately in the recycling process and used to make the forms in the present invention.

Example of Manufacturing Method of the Non-Ferrous Stay-in-Place Forms

Using an Isodan A/S machine, a mobile unit designed for mechanical recycling of composites of many sorts, including wind blades, end of life (EOL) wind blades are cut and fed into the machine and thereby shredded. The shredded material consisting of fiberglass which can be made in different lengths depending on preference, is then introduced to one of any number of possible pelletizing machines available on the market that converts the shredded FRP thermoset material to small pellets. These pellets are then introduced to a large-scale 3D printer made by CEAD (Netherlands) and combined with some thermoplastic material such that the 3D Printer is able to produce the forms from the material. 90% recycled FRP is combined with 10% thermoplastic material and/or resin from either recycled products or in virgin form. Various ratios of composite material (FRP) and thermoplastic can be used depending on the desired tensile strength and shape of the form. Some forms may require a greater amount of thermoplastic additive than others in order to achieve the necessary reinforcement effect on the poured concrete. The 3D printer then prints the non-ferrous stay-in-place forms.

Figure 2A:
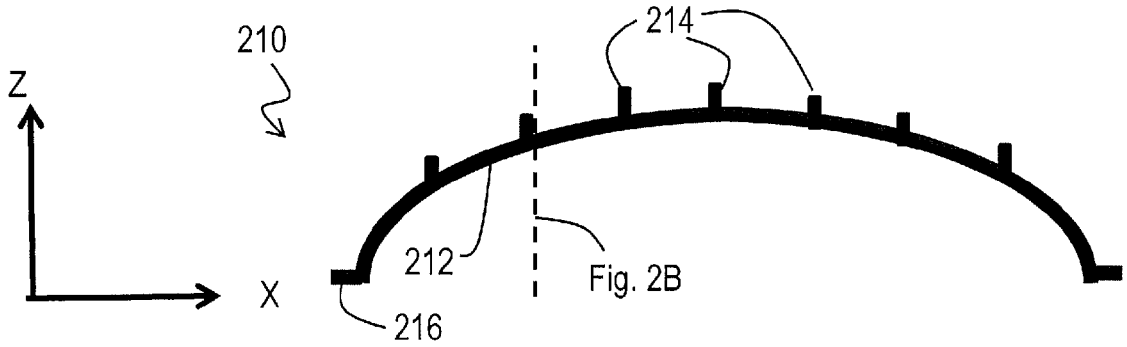
FIG. 2A and FIG. 2B are block diagrams that illustrate an example consumable form that mitigates or eliminates the need for steel or GFRP rebar reinforcing, according to an embodiment.
Figure 2B:
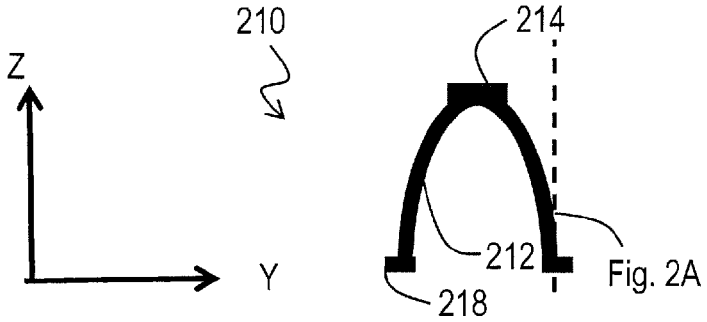
Figure 6A:
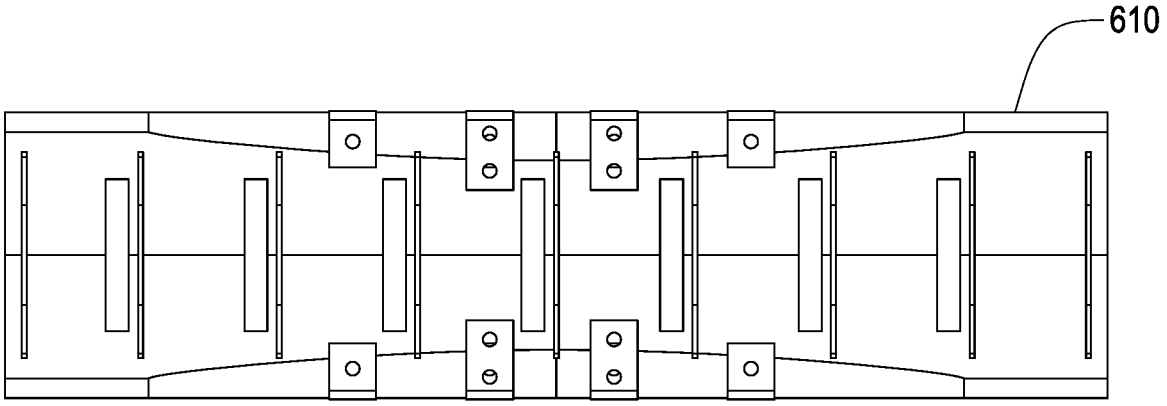
FIG. 6A and FIG. 6C and FIG. 6H and FIG. 6I are perspective drawings that depict an example plastic and/or FRP form for forming a chamber of intersecting arches from above, from the side, from the front, and obliquely, respectively, according to an embodiment.

The following figures illustrate how the product looks. FIG. 2A and FIG. 2B are block diagrams that illustrate an example consumable form 210 that mitigates the need for steel reinforcing, according to an embodiment of the present invention. This example embodiment also stacks sufficiently well to allow many such forms to be transported together on a flatbed truck or rail car or cargo hold of ship or aircraft or other vehicle. In this illustration, Z refers to the vertical direction, while X and Y refer to perpendicular horizontal directions. In the illustrated embodiment, the form has a curved plate 212 that is arched over a long distance in the X-Z plane and arched over a shorter distance in the perpendicular Y-Z plane. In addition, the framework has an articulated surface with protuberances 214, such as flanges, which increase surface friction and allow the concrete to grab, and transfer tensile stresses to, and otherwise interact with the form 210. In some embodiments, at different cross sections, the form does not reach the ground so as to provide opening between chambers generated by the form, as shown in more detail for the example embodiment with reference to FIG. 6A and following. The cross sections depicted were selected to show that the form reaches the ground to form at least four legs to support the form and the resulting structure. In some embodiments, only three legs are used; and, in other embodiments, more than four legs are formed. In some embodiments, the form 210 also includes components 216 and 218 that serve as spacers to control the separation between adjacent forms when placed at a construction site in the X and Y directions, respectively.

Overview of Method of Use

Figure 3A:
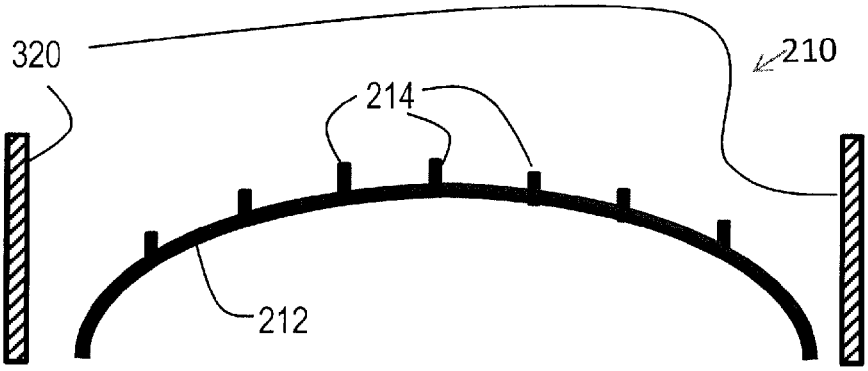
FIG. 3A and FIG. 3B are block diagrams that illustrate example use of multiple consumable forms that mitigates or eliminates the need for steel reinforcing to frame a structure, according to an embodiment.
Figure 3B:
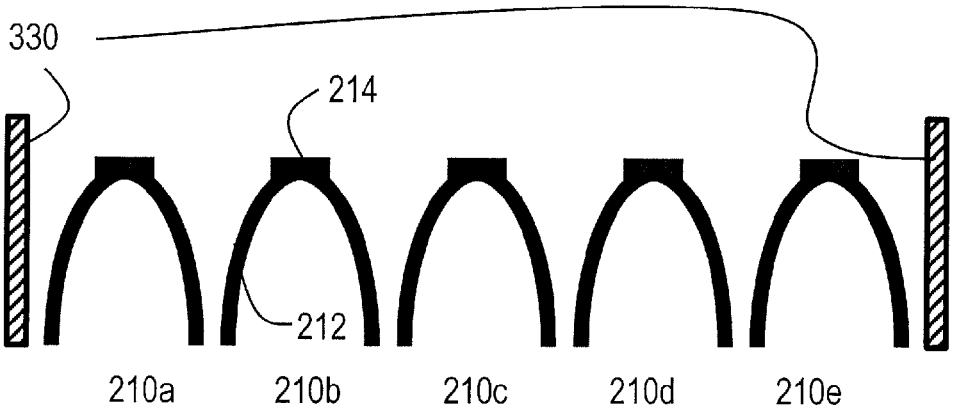

FIG. 3A and FIG. 3B are block diagrams that illustrate example use of multiple consumable plastic/FRP forms that mitigates the need for steel reinforcing to frame a structure, according to an embodiment. As depicted, a single form 210 is placed in the X direction between two simple vertical forms 320 in the Y-Z plane. In other embodiments, more forms are placed in the X-direction. Multiple forms 210*a*, 210*b*, 210*c*, 210*d* and 210*e* are placed in the Y direction between two simple vertical forms 330 in the X-Z plane. In other embodiments, fewer or more forms are placed in the Y direction. In some embodiments, the spacing between adjacent forms is varied or subject to the discretion of the builder. In some embodiments, the forms are spaced at least a distance apart determined by any spacers 216, 218 present on the forms. The forms are then filled with concrete to a level above the highest portion of the forms and protuberances 214. In some embodiments, the forms 210*a* through 210*e* are each shored up with one or more supports until the concrete cures into a solid form.

Figure 4A:
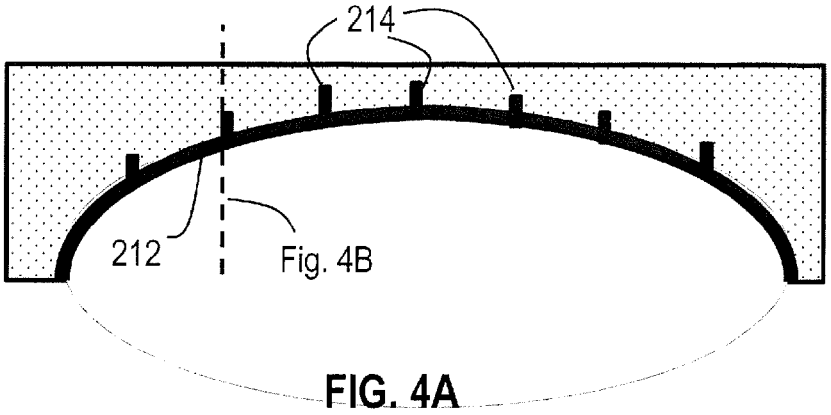
FIG. 4A and FIG. 4B are block diagrams that illustrate an example structure resulting from use of multiple consumable forms that mitigates or eliminates the need for steel reinforcing, according to an embodiment.
Figure 4B:
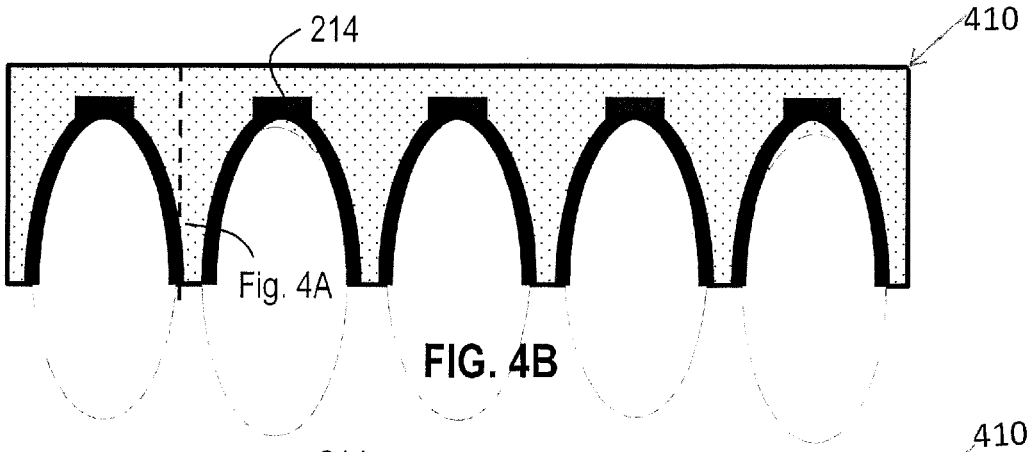

FIG. 4A and FIG. 4B are block diagrams that illustrate an example structure resulting from use of multiple consumable forms that mitigates the need for steel reinforcing, according to an embodiment. In the X-Z plane the structure forms a chamber that has an arched ceiling that is high enough to serve its purpose, e.g., greater than or equal to the height of the persons or animals or equipment or provisions to be housed in the structure. In the Y-Z plane the structure has multiple arched entrances to the interior chamber or chambers. The top of the structure provides a flat floor 410 for the next story. Where both the X-Z form and the Y-Z form touch the ground, a leg is formed that stands on the ground and supports the vaulted ceiling 420 and flat floor 410 with pure compressive stress well supported by the concrete. A second story can then be formed by repeating the process depicted in FIG. 3A and FIG. 3B on top of the structure depicted in FIG. 4A and FIG. 4B.

Figure 4C:
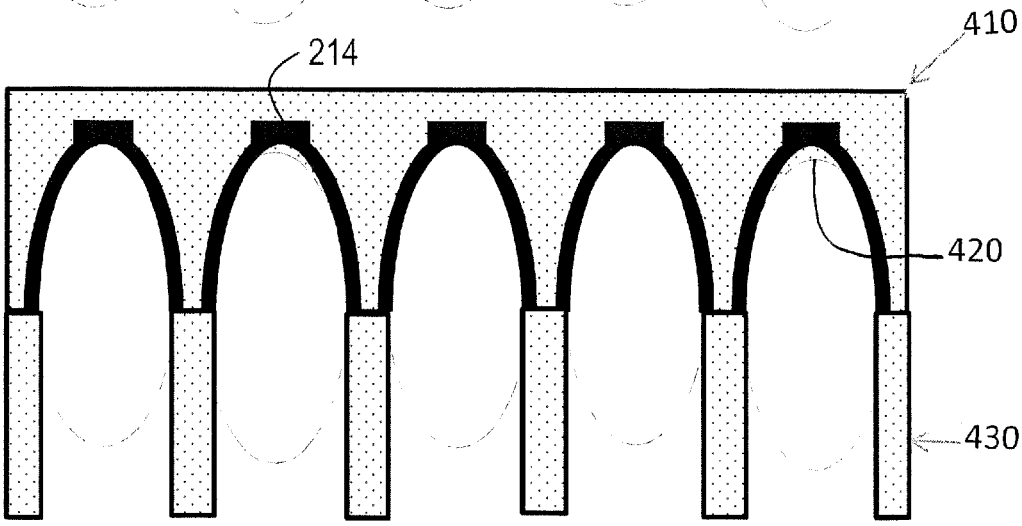
FIG. 4C and FIG. 4D are block diagrams that illustrate an example structure resulting from use of multiple consumable forms and pillars, according to an embodiment.
Figure 4D:
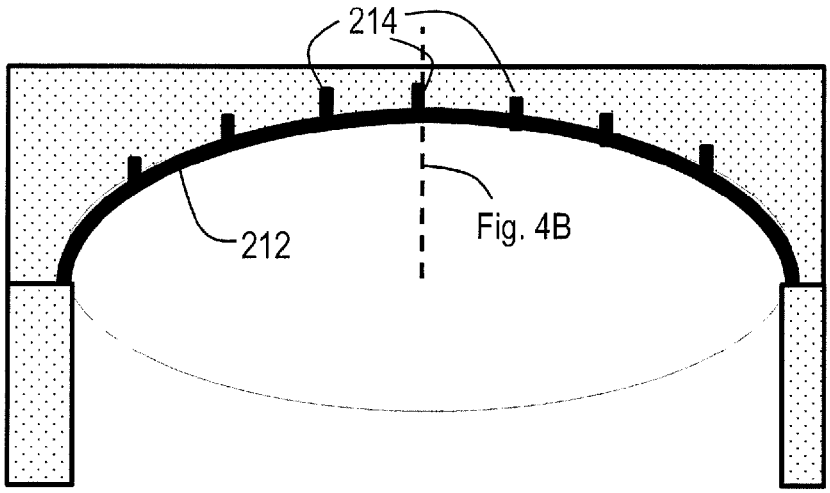

FIG. 4C and FIG. 4D are block diagrams that illustrate an example structure resulting from use of multiple consumable forms and pillars 430, according to an embodiment. In this embodiment, pillars are formed using conventional or simple forms, or preformed pillars are erected, and the forms are placed on top of the pillars. FIG. 4C shows the relationship of legs to pillars in the Y-Z plane; (the pillars are shown in black and occur only at the ends of the form) and, FIG. 4C shows the relationship of legs to pillars in the X-Z plane. After concrete is poured and cured, the structure sits atop pillars; one pillar supporting each leg.

Figure 5A:
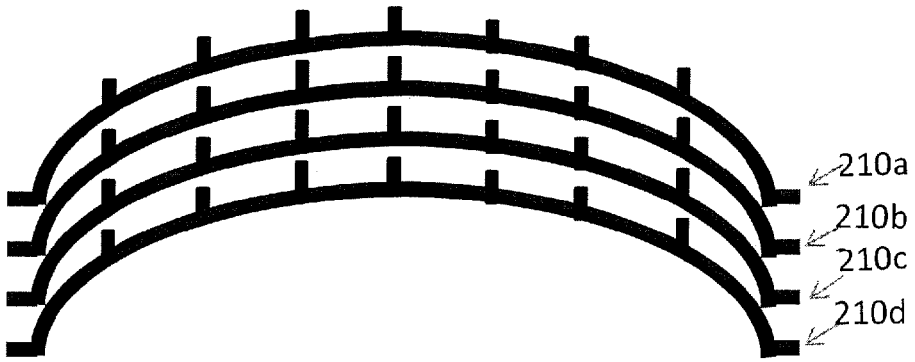
FIG. 5A and FIG. 5B are block diagrams that illustrate example stacking of multiple consumable forms that mitigates or eliminates the need for steel reinforcing, according to an embodiment.
Figure 5B:
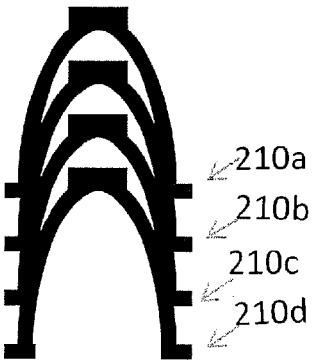

FIG. 5A and FIG. 5B are block diagrams that illustrate example stacking of multiple consumable forms 210*a-d* that mitigates or eliminates the need for steel reinforcing, according to an embodiment. Such stacking is advantageous for the transport of multiple forms to a building site on truck, train, boat or aircraft.

Experimental Embodiment

According to an example experimental embodiment, a scale model was constructed to test the strength of the resulting structure. It is desirable in building applications that a floor be able to withstand a bending load of 30 pounds per square foot (psf, 1 psf=47.8803 newtons per square meter) for the life of the building for most residential and light commercial applications. The experimental embodiment presented here demonstrates that this embodiment would allow for quick and less expensive means to build flat floors and/or roofs that are capable of holding 30 pounds per square foot of live load or more.

To test the ideas, we had 1/24 scale models of the form made of plastic (nylon 6) on a 3D printer. A structure was assembled as it would be in the field by pouring concrete on the form. This gave a platform of 8"×6" which is one third of a square foot (48 square inches is one third of 144 square inches equal to one square foot). Considering what is happening on the molecular level, the 1/24 scale would seem an insignificant magnitude difference—particularly since both the model and the full-scale version would ultimate act monolithically. After 28 days of curing time the structure was loaded with 10 pounds 7 ounces which is the equivalent of over 31 psf. After a week, the load has held without cracking or failure. After carrying the load for 4 weeks, the load was increased repeatedly until failure.

Figure 6B:
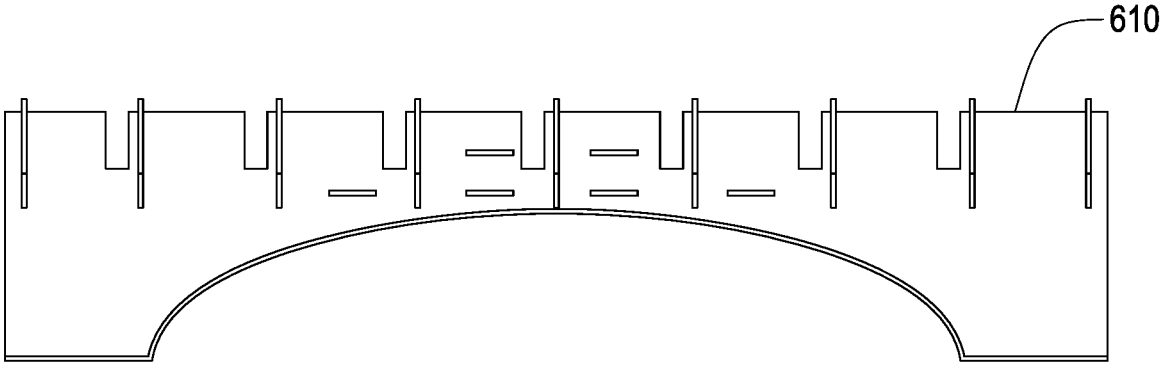
FIG. 6B is perspective drawing that depicts an inside half view of the same example plastic and/or FRP form, according to an embodiment.
Figure 6C:
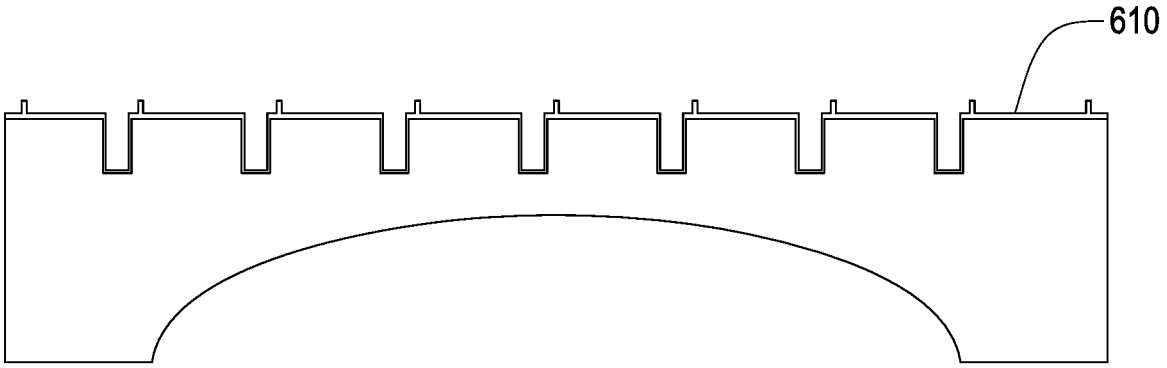

FIG. 6A and FIG. 6C and FIG. 6H and FIG. 6I are perspective drawings that depict an example plastic form 610 for forming a chamber of intersecting arches from above, from the side, from the front, and obliquely, respectively, according to an embodiment. FIG. 6B is perspective drawing that depicts an inside half view of the same example plastic, according to an embodiment. This design for the form provides for substantial intrusions of concrete between horizontally displaced portions of the frame to more fully engage the tensile strength of the form with the tensile stresses on the structure.

Figure 6D:
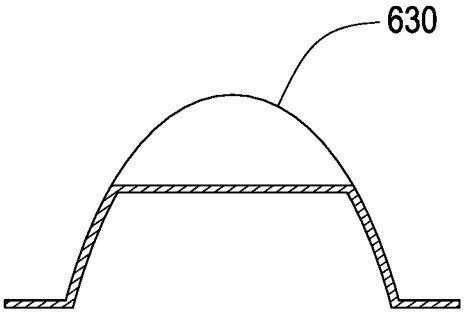
FIG. 6D through FIG. 6G are cross sectional drawings that depict the same example plastic and/or FRP form at different longitudinal positions, according to an embodiment.
Figure 6E:
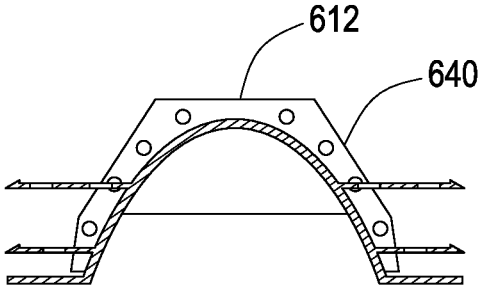
Figure 6F:
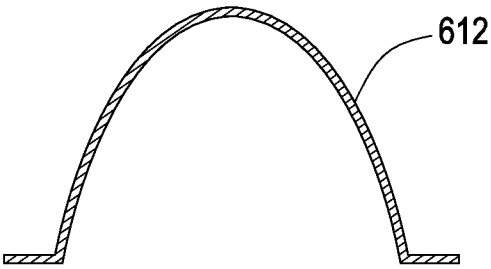
Figure 6G:
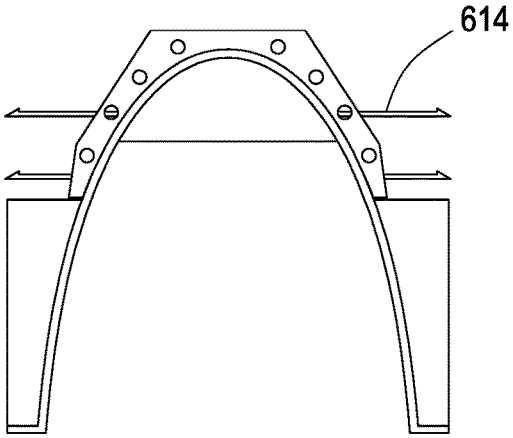
Figure 6H:
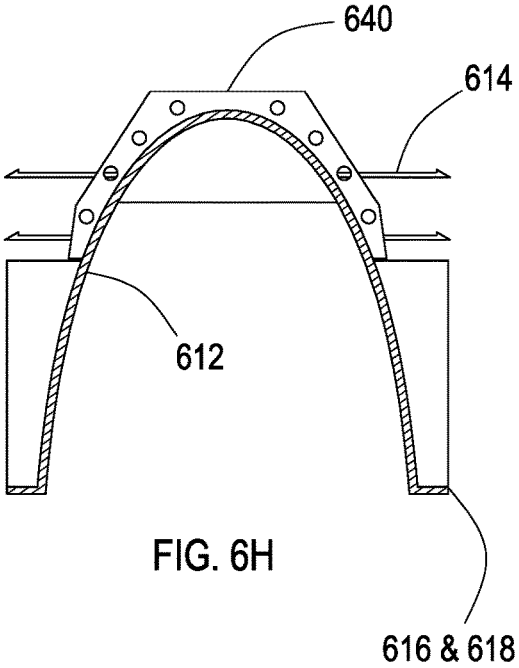
Figure 6I:
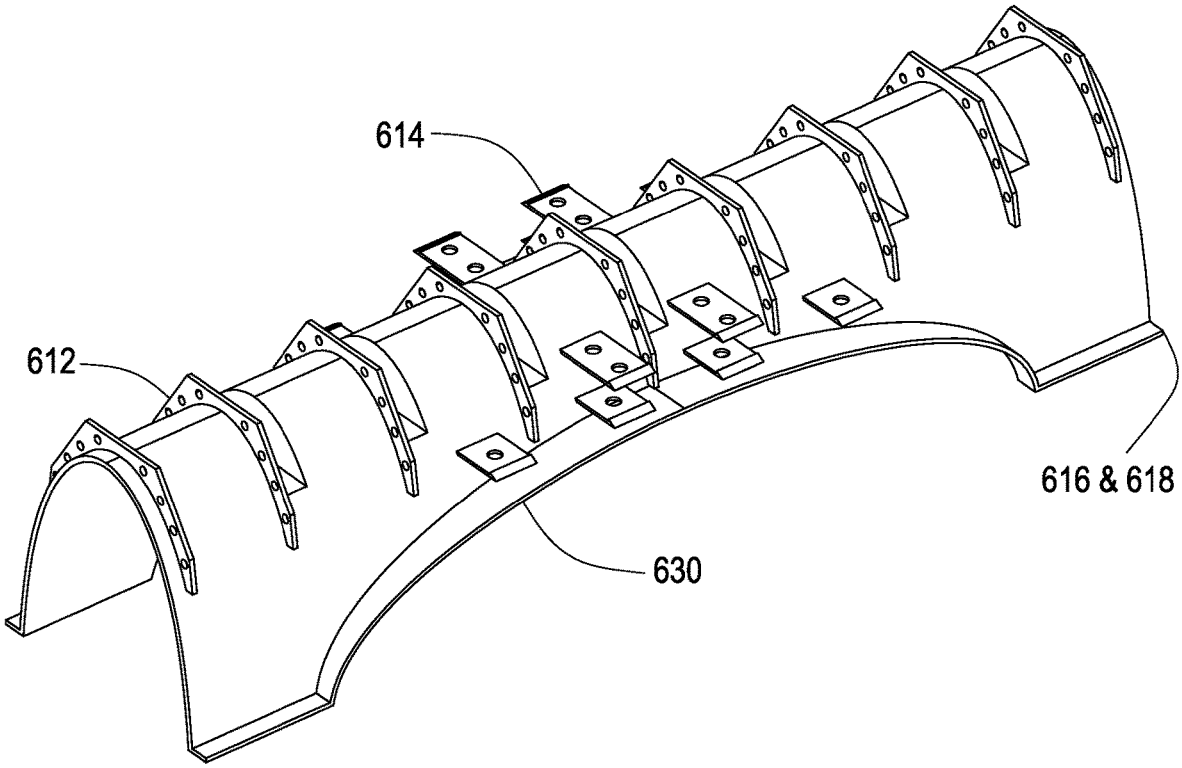

FIG. 6D through FIG. 6G are cross sectional drawings that depict the same example plastic form at different longitudinal positions, according to an embodiment. At different longitudinal positions, the form descends less far from the top and includes a shelf 620 that holds cement above the form and covers the distance to the next adjacent form. FIG. 6D shows a solid section 630 that represents the dips in the form that allow the substantial intrusion of concrete below the top profile of the form. FIG. 6E shows a flange with holes 640 to engage the concrete and help transfer tensile stresses from the concrete to the form.

Figure 7:
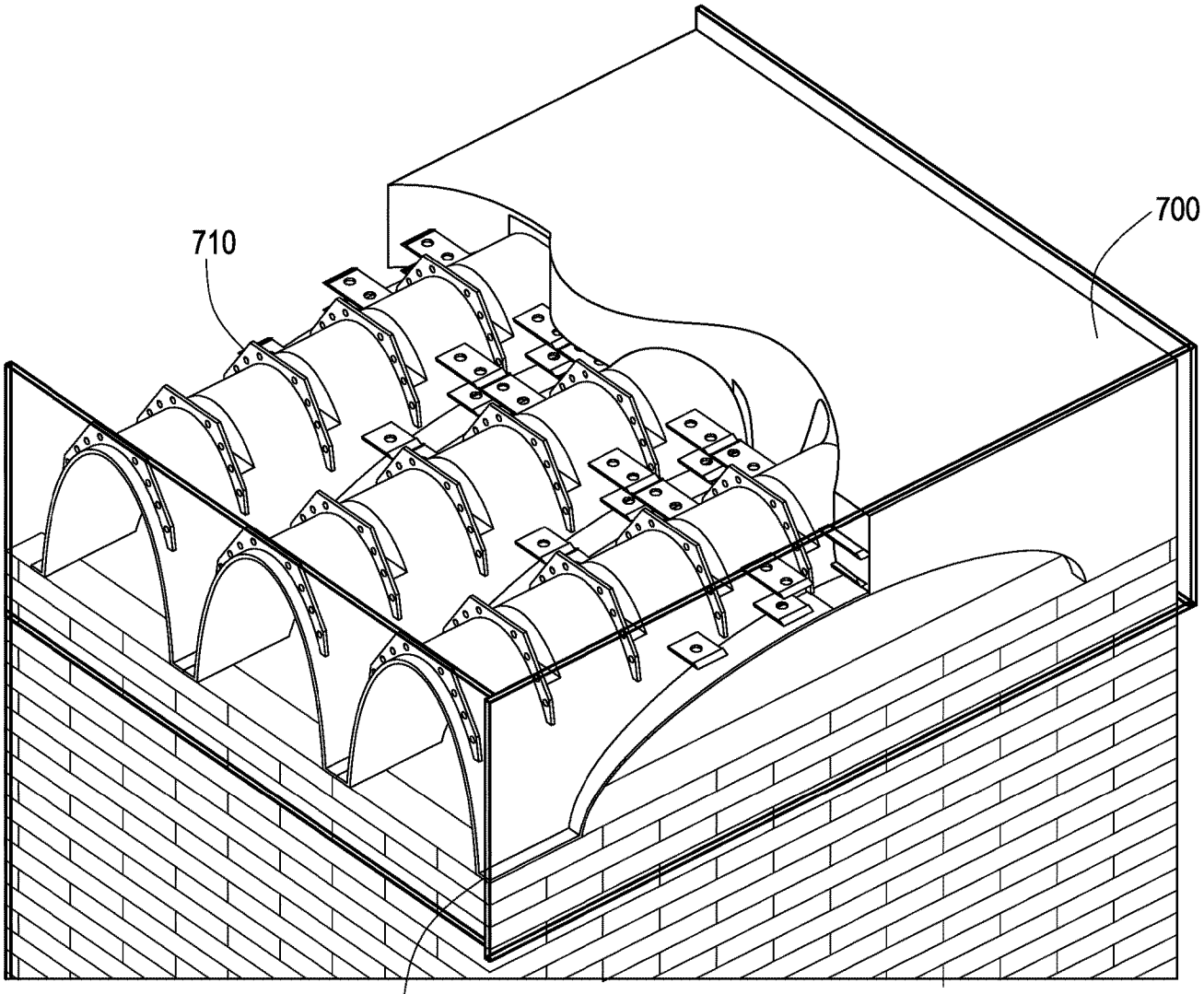
FIG. 7 is perspective drawing that depicts pouring cement (concrete) onto multiple forms of the type depicted in FIG. 6A through FIG. 6I, according to an embodiment; the concrete can be low carbon with weaker structure and therefore higher tensile strength requirements or greater reinforcement needs.

FIG. 7 is a perspective drawing that depicts pouring cement 700 onto multiple forms 710 of the type depicted in FIG. 6A through FIG. 6I, according to an embodiment. The forms are set above walls 720 to form a vaulted ceiling for a rectangular room and a floor for the story above.

Figure 8A:
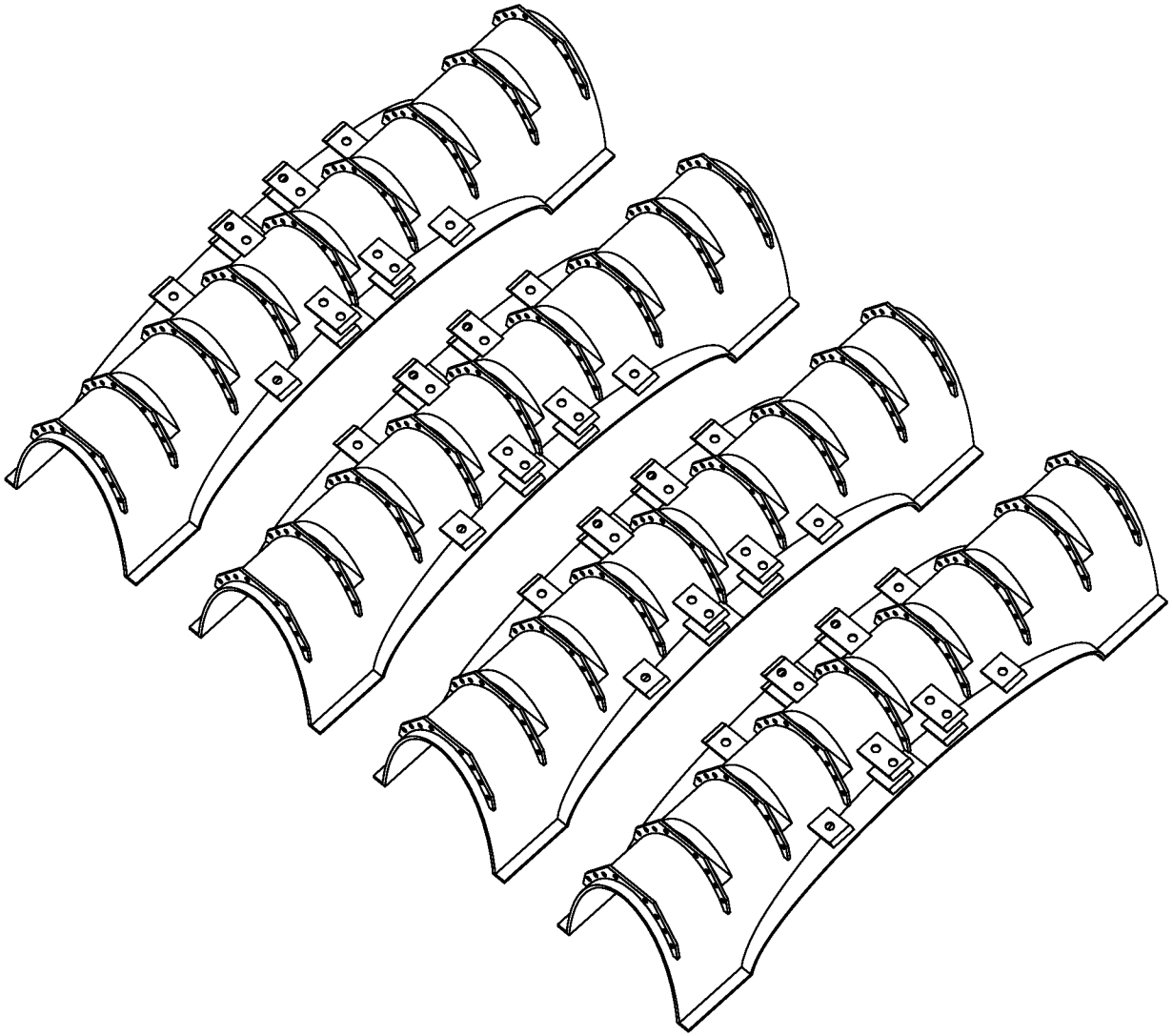
FIG. 8A is a photograph that depicts an example set of four plastic forms scaled down to a length of about one foot and a width of about 3 inches, according to an embodiment.
Figure 8B:
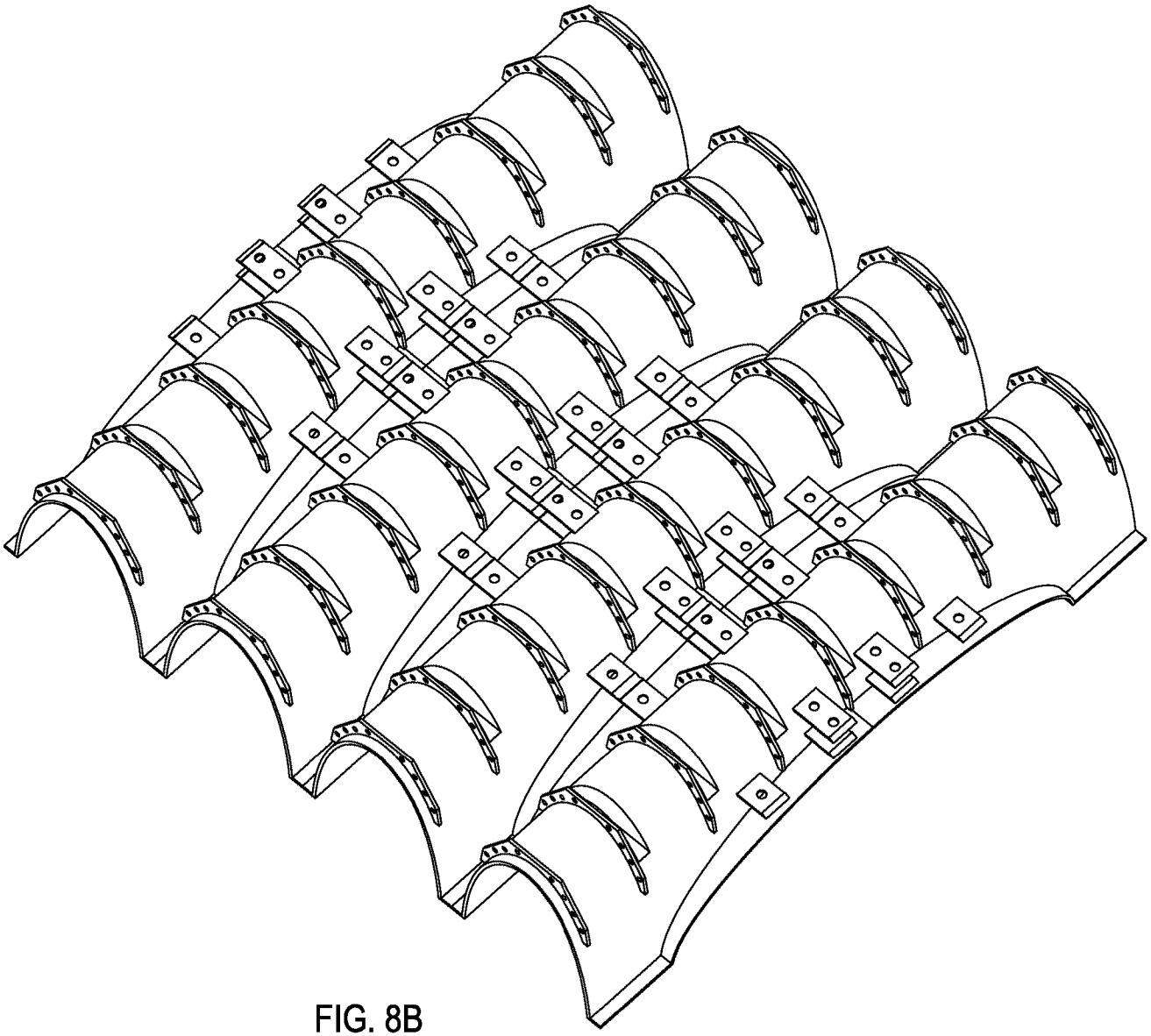
FIG. 8B is a photograph that depicts the example set of four plastic forms from FIG. 8A, set adjacent to each other for framing a concrete structure of one square foot, according to an embodiment.
Figure 8C:
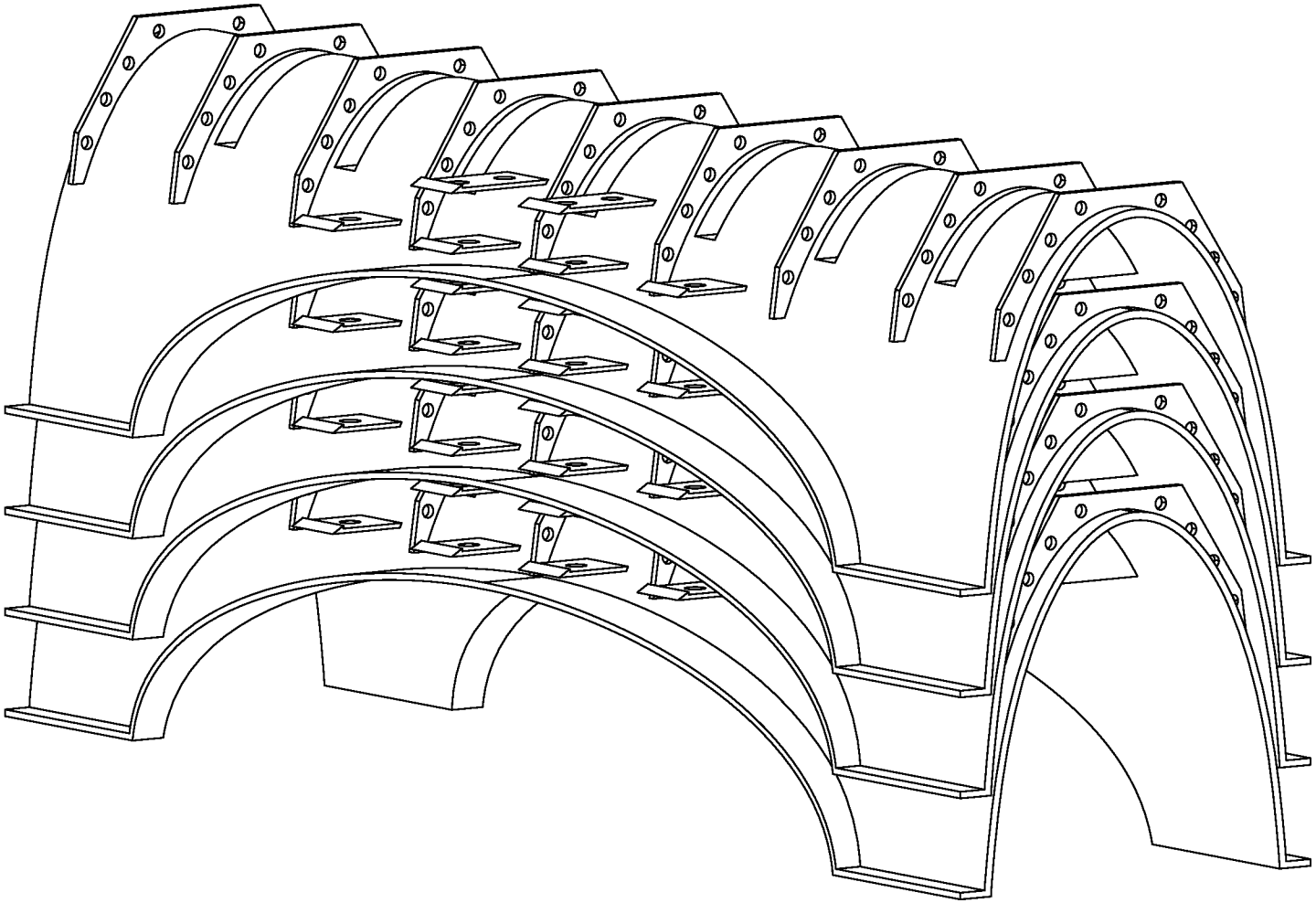
FIG. 8C is a photograph that depicts the example set of four plastic forms from FIG. 8A stacked for transport, according to an embodiment; such forms are made of recycled wind blade (FRP) material or other recycled composite materials and/or recycled plastic.

FIG. 8A is a photograph that depicts an example set of four plastic forms scaled down to a length of about one foot and a width of about 3 inches, according to an embodiment. FIG. 8B is a photograph that depicts the example set of four plastic forms from FIG. 8A, set adjacent to each other for framing a concrete structure of one square foot, according to an embodiment. FIG. 8C is a photograph that depicts the example set of four plastic forms from FIG. 8A stacked for transport, according to an embodiment.

Figure 9A:
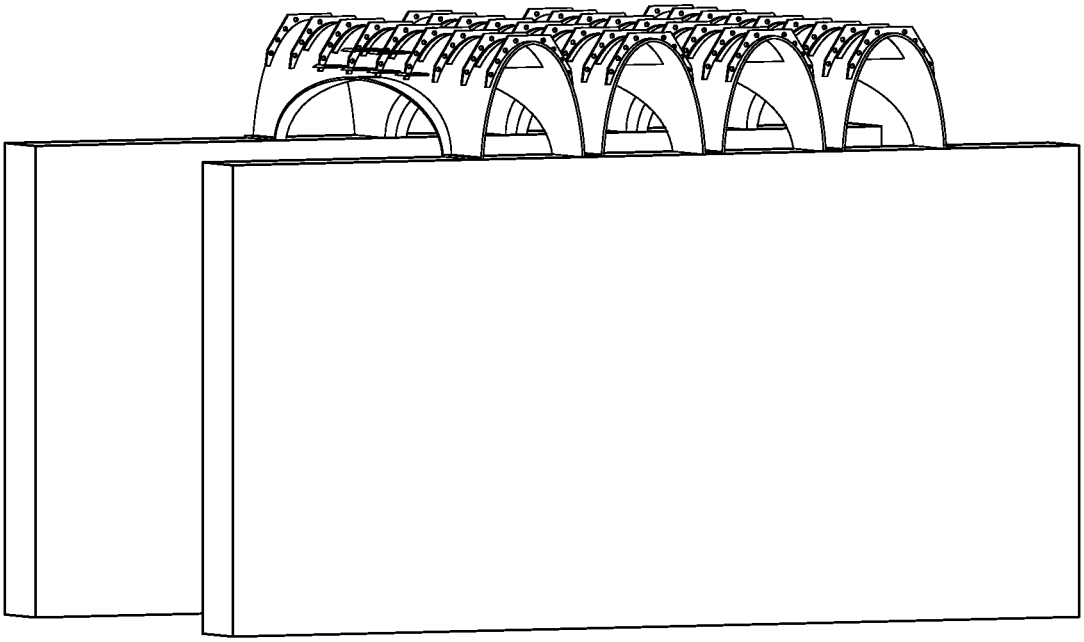
FIG. 9A is a photograph that depicts the example set of four plastic forms from FIG. 8A, set adjacent to each other for framing a concrete structure on a wall of plywood planks, according to an embodiment.
Figure 9B:
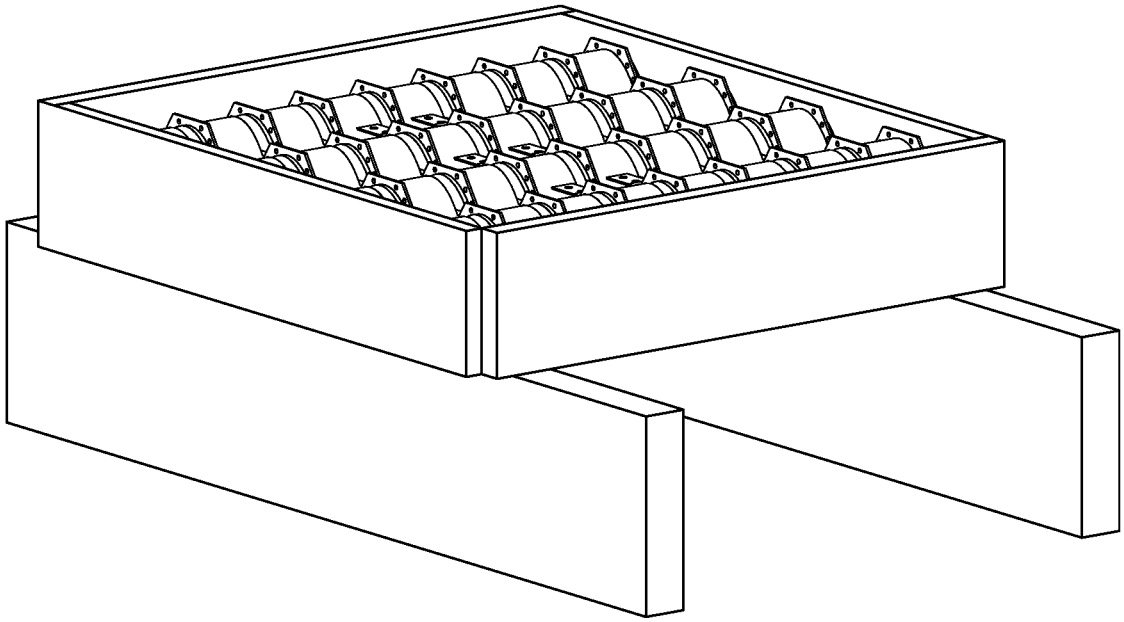
FIG. 9B is a photograph that depicts the example set of four plastic forms from FIG. 8A, set adjacent to each other for framing a concrete structure on a wall of plywood planks with simple side framing, according to an embodiment.
Figure 9C:
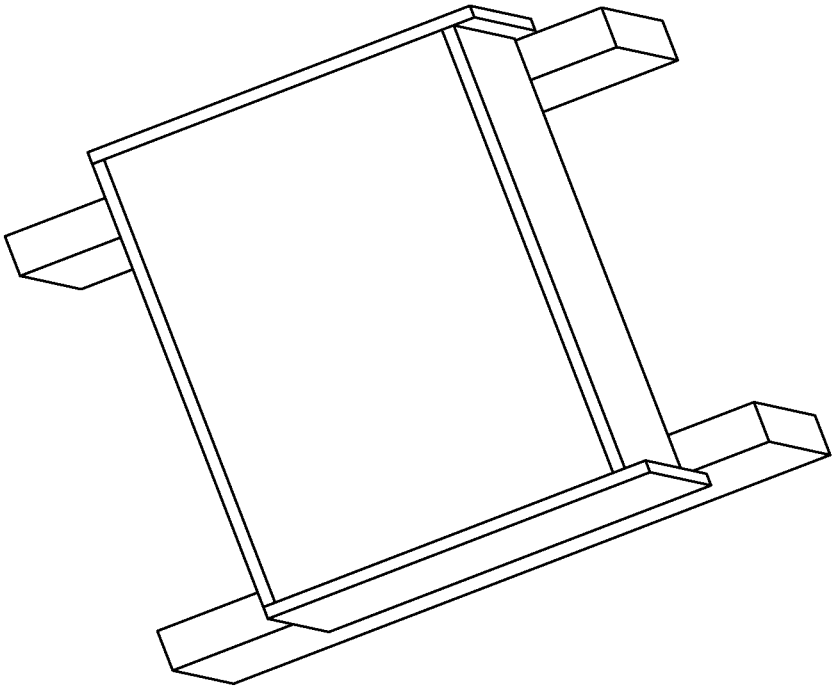
FIG. 9C is a photograph that depicts the example framing of FIG. 9B after pouring concrete, according to an embodiment.
Figure 9D:
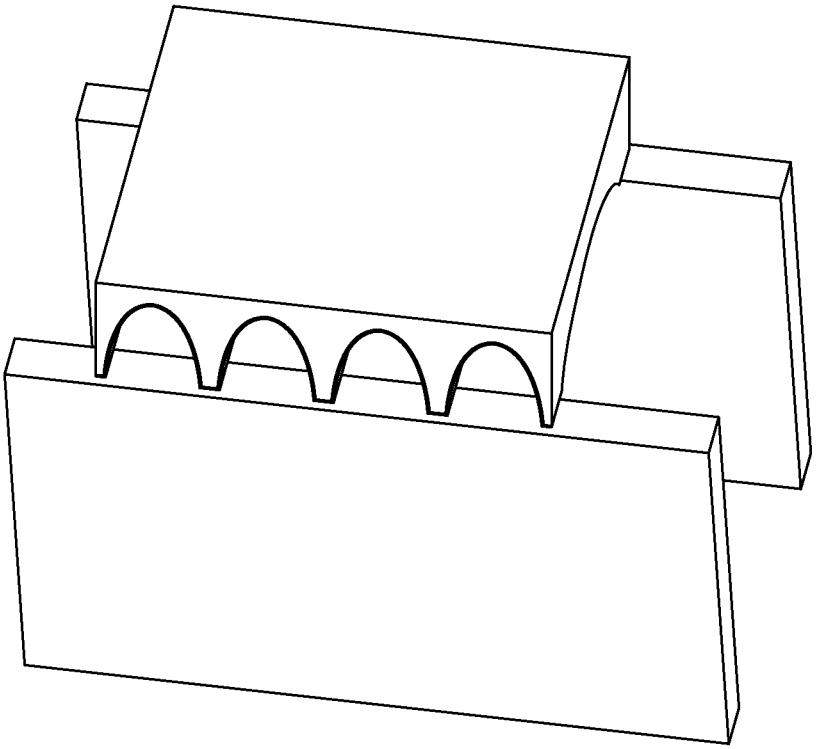
FIG. 9D is a photograph that depicts an example structure incorporating the example plastic forms of FIG. 9A, according to an embodiment.

FIG. 9A is a photograph that depicts the example set of four plastic forms from FIG. 8A, set adjacent to each other for framing a concrete structure on a wall of plywood planks, according to an embodiment. FIG. 9B is a photograph that depicts the example set of four plastic forms from FIG. 8A, set adjacent to each other for framing a concrete structure on a wall of plywood planks with simple side framing, according to an embodiment. FIG. 9C is a photograph that depicts the example framing of FIG. 9B after pouring concrete, according to an embodiment. FIG. 9D is a photograph that depicts an example structure incorporating the example plastic forms of FIG. 9A, according to an embodiment. This structure provides a vaulted ceiling for the room between the two plywood planks and a floor for a story above.

Figure 10A:
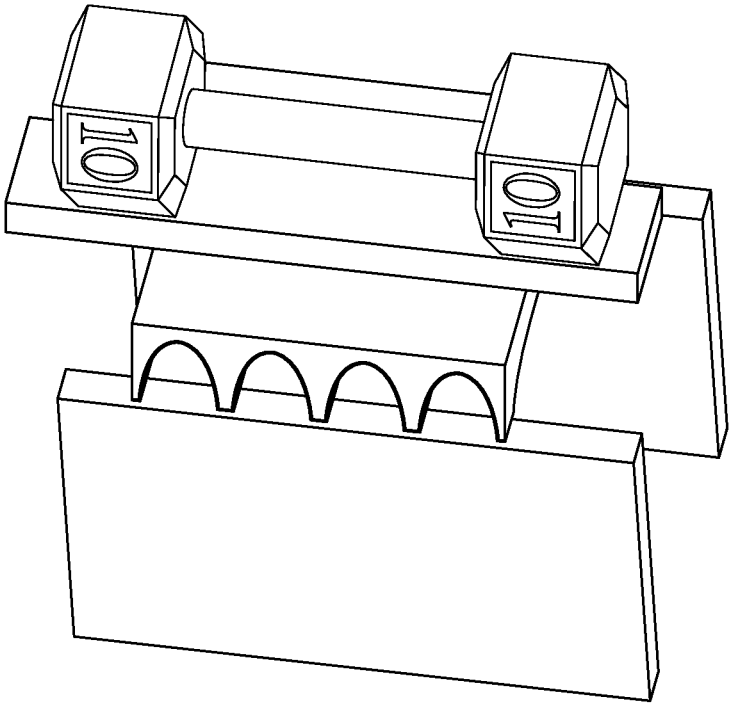
FIG. 10A is a photograph that depicts the example structure of FIG. 9D externally loaded with a bending stress of 10 pounds, according to an embodiment.
Figure 10B:
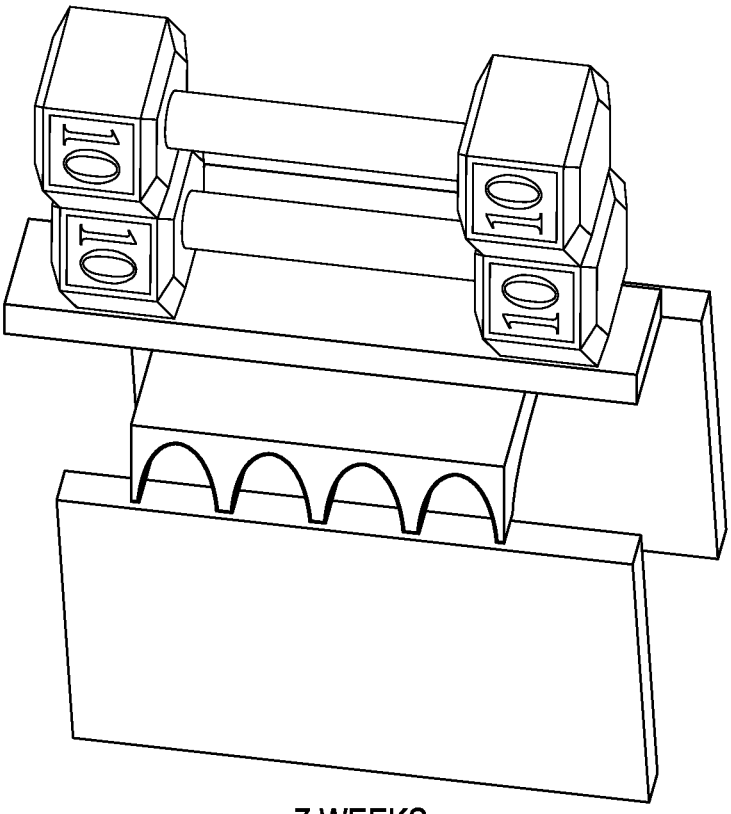
FIG. 10B is a photograph that depicts the example structure of FIG. 9D externally loaded with a bending stress of 20 pounds (approx. 9 kg) and then maintained for 7 weeks, according to an embodiment.

FIG. 10A is a photograph that depicts the example structure of FIG. 9D externally loaded with a bending stress of 10 pounds plus 7 ounces of a two by four, according to an embodiment. FIG. 10B is a photograph that depicts the example structure of FIG. 9D externally loaded with a bending stress of 20 pounds and then maintained for 7 weeks, according to an embodiment. No failure by the structure is indicated, suggesting that the tensile strength provided by the plastic frame suffices for a sustained external load of 3×20=60 pounds per square foot.

Figure 10C:
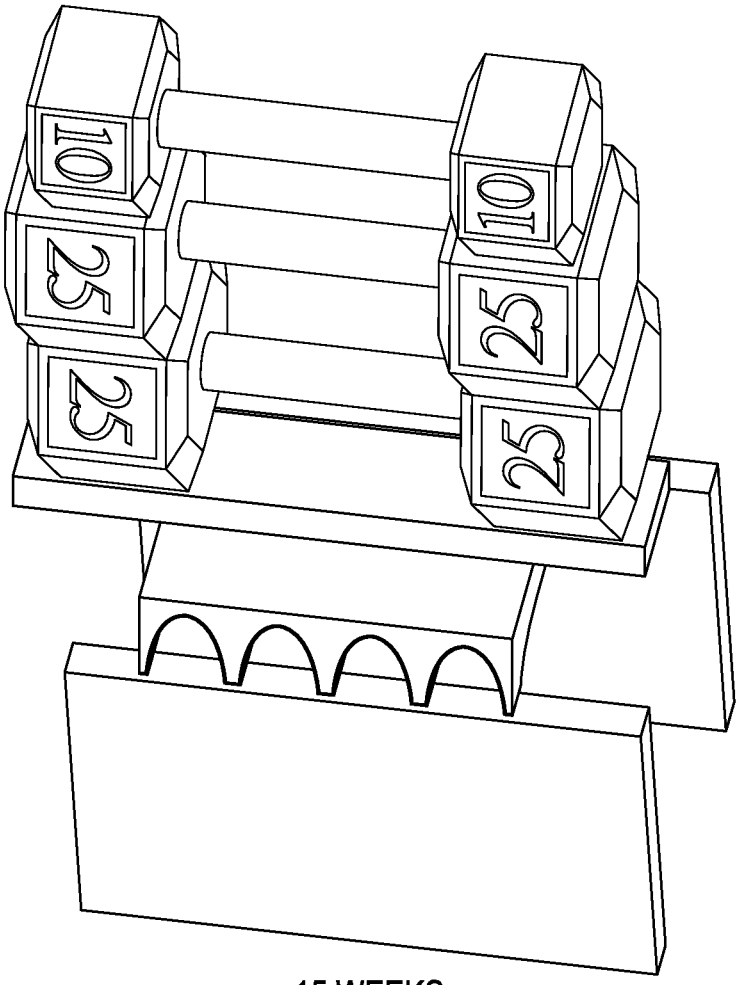
FIG. 10C is a photograph that depicts the example structure of FIG. 9D externally loaded with a bending stress of 50 pounds (approx. 22.6 kg) through 15 weeks after adding another 10 pounds for a total of 60 pounds, according to an embodiment.

FIG. 10C is a photograph that depicts the example structure of FIG. 9D externally loaded with a bending stress of 50 pounds through 15 weeks after adding another 10 pounds for a total of 60 pounds, according to an embodiment. No failure by the structure is indicated, suggesting that the tensile strength provided by the plastic frame suffices for a sustained external load of at least 50×3=150 pounds per square foot and a temporary load of 3×60=180 pounds per square foot.

Figure 10D:
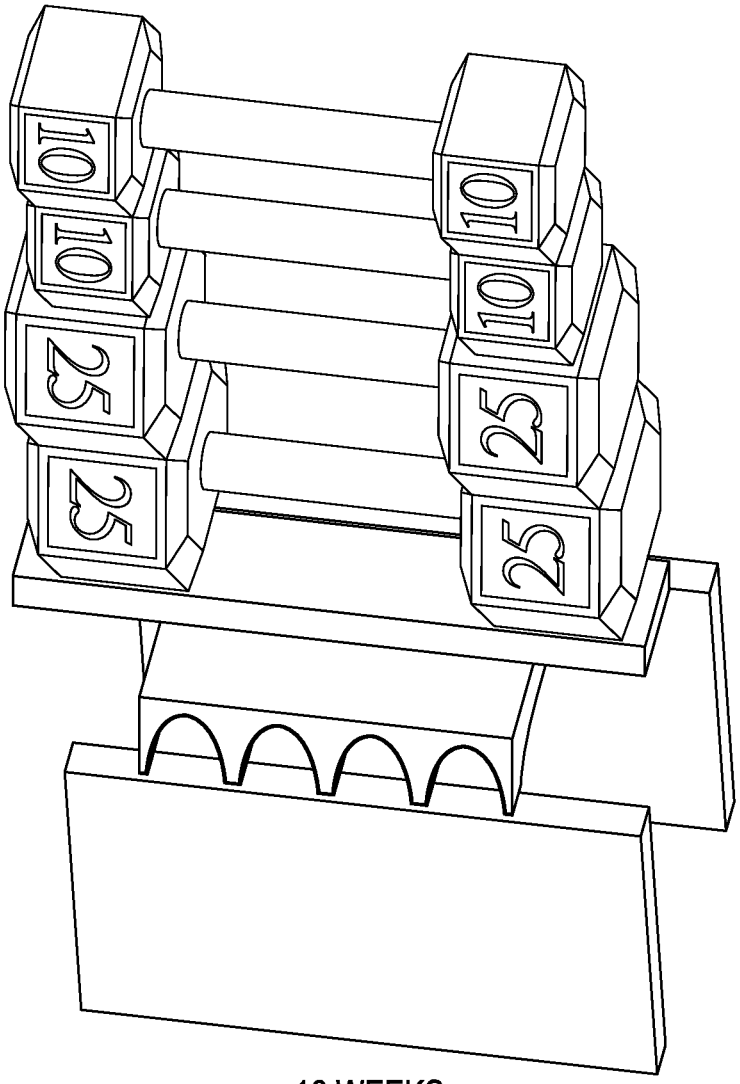
FIG. 10D is a photograph that depicts the example structure of FIG. 9D externally loaded with a bending stress of 60 pounds through 16 weeks after adding another 10 pounds for a total of 70 pounds, according to an embodiment.

FIG. 10D is a photograph that depicts the example structure of FIG. 9D externally loaded with a bending stress of 60 pounds through 16 weeks after adding another 10 pounds for a total of 70 pounds, according to an embodiment. No failure by the structure is indicated, suggesting that the tensile strength provided by the plastic frame suffices for a sustained external load of at least 3×60=180 pounds per square foot and a temporary load of 3×70=210 pounds per square foot.

Figure 10E:
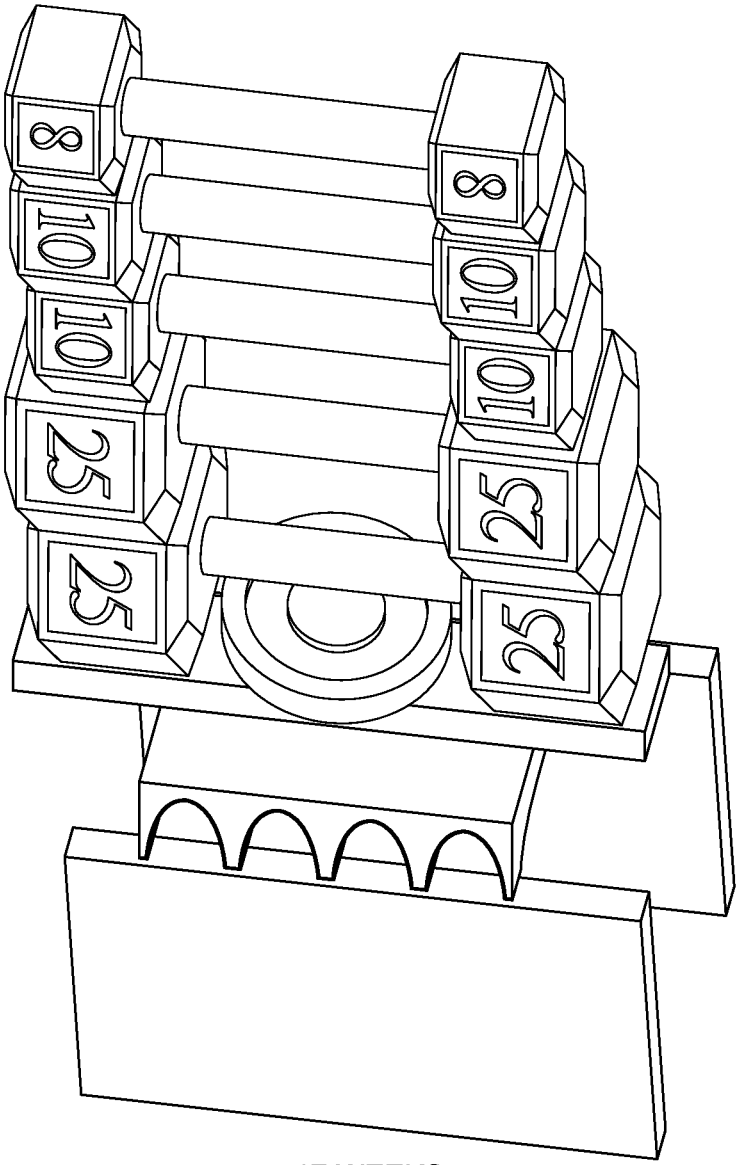
FIG. 10E is a photograph that depicts the example structure of FIG. 9D externally loaded with a bending stress of 70 pounds through 17 weeks after adding another 11 pounds (an 8 pound barbell and a 3 pound disk) for a total of 81 pounds, according to an embodiment.

FIG. 10E is a photograph that depicts the example structure of FIG. 9D externally loaded with a bending stress of 70 pounds through 17 weeks after adding another 11 pounds (an 8-pound barbell and a 3-pound disk) for a total of 81 pounds, according to an embodiment. No failure by the structure is indicated, suggesting that the tensile strength provided by the plastic frame suffices for a sustained external load of at least 3×70=210 pounds per square foot and a temporary load of 3×81=243 pounds per square foot.

Figure 10F:
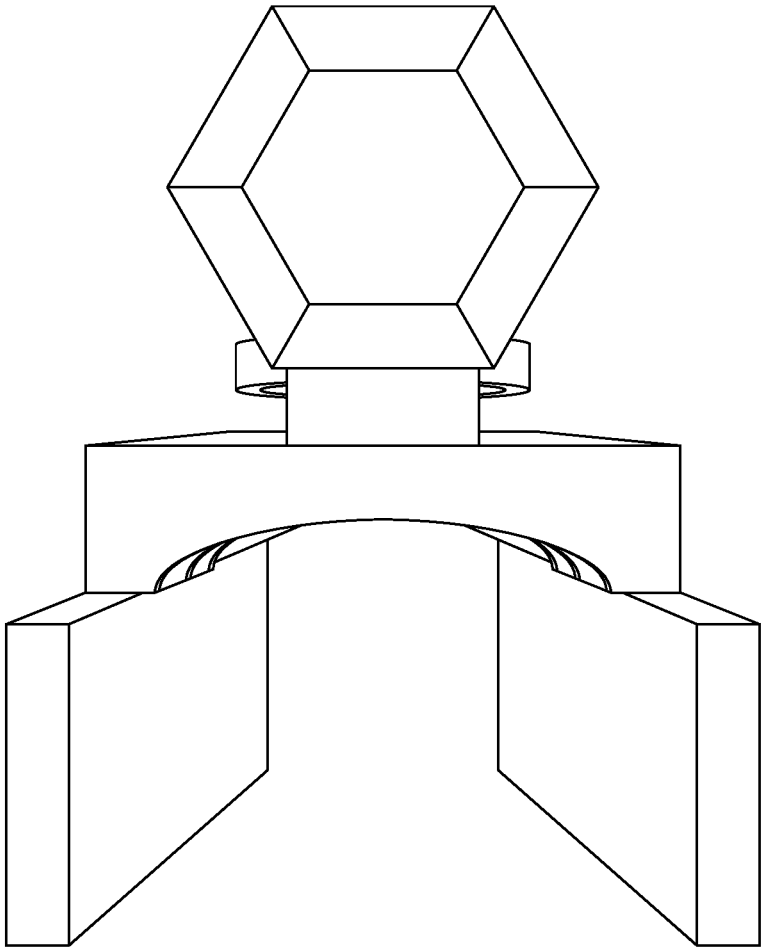
FIG. 10F is a photograph that depicts a side view of the example structure of FIG. 9D with 81 pounds per square foot at 17 weeks, according to an embodiment.

FIG. 10F is a photograph that depicts a side view of the example structure of FIG. 9D with 81 pounds at 17 weeks, according to an embodiment. A straight edge shows that there is very slight bending, as evident from the center of the structure being slightly closer to the straight edge than the legs of the structure.

After additional weight was added, the structure failed. The forms and concrete held 70 pounds securely with slight deformation. When the load was increased to 81 pounds, the form and concrete only held for a couple of hours before it collapsed. Support at 70 pounds translates to a load of 210 psf (10,054 n/m2); failure was at 81 pounds which translates to a load of 243 psf (11,635 n/m2).

In the foregoing specification, the invention has been described with reference to specific embodiments thereof. It will, however, be evident that various modifications and changes may be made thereto without departing from the broader spirit and scope of the invention. The specification and drawings are, accordingly, to be regarded in an illustrative rather than a restrictive sense. Throughout this specification and the claims, unless the context requires otherwise, the word "comprise" and its variations, such as "comprises" and "comprising," will be understood to imply the inclusion of a stated item, element or step or group of items, elements, or steps but not the exclusion of any other item, element or step or group of items, elements, or steps. Furthermore, the indefinite article "a" or "an" is meant to indicate one or more of the item, element, or step modified by the article.

What is claimed is:

1. A building component system for building concrete flatwork structures comprising a non-ferrous form or profile with grooves at least in a top surface of the form or profile and a plurality of protrusions extending up from the top surface of the form or profile, said form or profile comprising at least 50% recycled material, the building component system further comprising cured concrete consisting only of unreinforced concrete bound to at least the plurality of protrusions and the grooves of said form or profile to form a building component, said form or profile staying in place and forming a part of the concrete flatwork structures built with the building component.

2. The building component system of claim 1, wherein the form or profile is comprised of 50% to 90% recycled composite material and 10% to 50% recycled or virgin thermoplastic material.

3. The building component system of claim 2, wherein the composite material is recycled fiberglass reinforced plastic (FRP).

4. The building component system of claim 3, where the recycled composite material comprises composite parts from products in the group consisting of wind turbine blades, boats, and aircraft.

5. The building component system of claim 2, wherein the thermoplastic material is from recycled plastic bottles.

6. The building component system of claim 2, wherein the form or profile is made by 3D Printing.

7. The building component system of claim 1, wherein the form or profile has an arched shape that forms a chamber underneath the form or profile having a vaulted ceiling with a shape selected from the group consisting of arches and domes.

8. The building component system of claim 1, wherein the flatwork structures comprise a roof, a floor, and a bridge decking reinforcement.

9. The building component system of claim 1, wherein the concrete is a low carbon concrete.

10. The building component systems of claim 1, wherein the form or profile is configured to be stackable such that a plurality of forms or profiles stack efficiently for transportation.

11. The building component system of claim 1, wherein a load capability of the flatwork structure built with the building component is 10.1 $kN/m^2$.

12. The building component system of claim 1, wherein the building component is thin having a height of less than 69 centimeters (or 2 feet, 3 inches).

13. The building component system of claim 1, wherein the building component has tensile strength that supports a load of at least 210 pounds per square foot (10,054 $n/m^2$).

14. A method of building concrete flatwork structures, the method comprising (a) forming a non-ferrous form or profile with grooves at least on a top surface of the form or profile and a plurality of protrusions extending up from the top surface of the form or profile, said form or profile comprising at least 50% recycled material, (b) curing and binding concrete consisting only of unreinforced concrete to at least the plurality of protrusions and the grooves of the form or profile to form a building component, said form or profile staying in place and forming a part of the concrete flatwork structures built with the building component.

15. The method of claim 14, wherein the form or profile comprises 50% to 90% recycled composite material and 10% to 50% recycled or virgin thermoplastic material.

16. The method of claim 14, wherein the forming step comprises using a 3D printing process to form the form or profile.

* * * * *